US010518432B2

(12) United States Patent
Aikens et al.

(10) Patent No.: US 10,518,432 B2
(45) Date of Patent: Dec. 31, 2019

(54) BLADE ASSEMBLY AND FOOD CUTTING DEVICE INCORPORATING THE SAME

(71) Applicant: McCain Foods Limited, Florenceville-Bristol (CA)

(72) Inventors: John Warren Aikens, New Maryland (CA); David M. Rogers, Woodstock (CA)

(73) Assignee: McCain Foods Limited, Florenceville-Bristol (CA)

( * ) Notice: Subject to any disclaimer, the term of this patent is extended or adjusted under 35 U.S.C. 154(b) by 0 days.

(21) Appl. No.: 15/454,552

(22) Filed: Mar. 9, 2017

(65) Prior Publication Data

US 2017/0182675 A1 Jun. 29, 2017

Related U.S. Application Data

(63) Continuation of application No. 14/242,232, filed on Apr. 1, 2014, now abandoned.

(51) Int. Cl.
*B26D 7/26* (2006.01)
*B26D 3/11* (2006.01)
(Continued)

(52) U.S. Cl.
CPC ..... *B26D 7/2614* (2013.01); *B26D 1/0006* (2013.01); *B26D 1/28* (2013.01);
(Continued)

(58) Field of Classification Search
CPC ..... B26D 7/0691; B26D 1/36; B26D 5/08; B26D 7/2614; B26D 1/006; B26D 1/28;
(Continued)

(56) References Cited

U.S. PATENT DOCUMENTS 310,394 A 1/1885 Ells
481,159 A 8/1892 Bohannan
(Continued)

FOREIGN PATENT DOCUMENTS

AT 386374 B 8/1988
AU 622356 B2 4/1992
(Continued)

OTHER PUBLICATIONS

GME International, "Using Computational Fluid Dynamics to Improve Cut Quality and Efficiency of a GME Hydro-Cutting System", CFD Analysis and Documentation Report dated Feb. 1, 2012.
(Continued)

*Primary Examiner* — Omar Flores Sanchez
(74) *Attorney, Agent, or Firm* — Bereskin & Parr LLP/S.E.N.C.R.L., s.r.l.

(57) ABSTRACT

A blade assembly is disclosed. The blade assembly includes a mounting ring, at least two elongate cutting blades, and a substantially circular central support positioned substantially at the center of the mounting ring. Each cutting blade may have a proximal end connected to the mounting ring. Each cutting blade may extend from the mounting ring toward a center of the mounting ring. Each cutting blade may be twisted along a length of the cutting blade. A distal end of each cutting blade may be connected to the central support.

26 Claims, 32 Drawing Sheets

(51) Int. Cl.

| | |
|---|---|
| ***B26D 1/00*** | (2006.01) |
| ***B26D 1/28*** | (2006.01) |
| ***B26D 5/20*** | (2006.01) |
| ***B26D 7/06*** | (2006.01) |

(52) U.S. Cl.

CPC ..... *B26D 3/11* (2013.01); *B26D 5/20* (2013.01); *B26D 7/0658* (2013.01); *B26D 2001/006* (2013.01); *B26D 2001/0033* (2013.01); *B26D 2210/02* (2013.01); *Y10T 83/869* (2015.04); *Y10T 83/9408* (2015.04)

(58) Field of Classification Search

CPC ..... B26D 3/11; B26D 5/20; B26D 7/0658; Y10T 83/0658; Y10T 83/9408

See application file for complete search history.

(56) References Cited

U.S. PATENT DOCUMENTS

| | | | | |
|---|---|---|---|---|
| 978,482 | A | 12/1910 | Petri | |
| 1,494,102 | A | 5/1924 | Cramer | |
| 1,512,484 | A | 10/1924 | Porter | |
| 1,909,029 | A | 5/1933 | Walter | |
| 2,482,523 | A | 9/1949 | Urschel et al. | |
| 2,787,273 | A | 4/1957 | Kerr | |
| 2,977,901 | A | 4/1961 | Deary, Sr. et al. | |
| 3,109,470 | A | 11/1963 | Urschel et al. | |
| 3,132,423 | A | 5/1964 | De Lano | |
| 4,198,887 | A | 4/1980 | Williams, Jr. | |
| 4,206,671 | A | 6/1980 | Hoehn | |
| 4,387,111 | A | 6/1983 | Muellender Gernot | |
| 4,393,737 | A | 7/1983 | Shibata | |
| 4,614,141 | A | 9/1986 | Mendenhall et al. | |
| 4,625,606 | A | 12/1986 | Pinegar et al. | |
| 4,644,838 | A | 2/1987 | Samson et al. | |
| 4,911,045 | A | 3/1990 | Mendenhall | |
| 4,966,542 | A | 10/1990 | Kobayashi | |
| 5,035,915 | A | 7/1991 | Mendenhall | |
| 5,046,388 | A | 9/1991 | Mendenhall | |
| 5,095,875 | A | 3/1992 | Morris et al. | |
| 5,097,735 | A | 3/1992 | Mendenhall | |
| 5,123,521 | A | 6/1992 | Mendenhall | |
| 5,167,177 | A | 12/1992 | Cimperman et al. | |
| 5,167,178 | A | 12/1992 | Cimperman et al. | |
| 5,168,784 | A | 12/1992 | Foster et al. | |
| 5,174,181 | A | 12/1992 | Julian et al. | |
| 5,179,881 | A | 1/1993 | Frey et al. | |
| 5,201,259 | A | 4/1993 | Covert et al. | |
| 5,211,098 | A | 5/1993 | Mendenhall | |
| 5,224,409 | A | 7/1993 | Cimperman et al. | |
| 5,277,546 | A | 1/1994 | Frey et al. | |
| 5,293,803 | A | 3/1994 | Foster | |
| 5,296,252 | A | 3/1994 | Mendenhall | |
| 5,343,791 | A | 9/1994 | Julian et al. | |
| 5,394,780 | A | 3/1995 | Foster et al. | |
| 5,394,793 | A | 3/1995 | Julian et al. | |
| 5,421,226 | A | 6/1995 | Mendenhall | |
| 5,473,967 | A | 12/1995 | Frey et al. | |
| 5,619,897 | A | 4/1997 | Dube et al. | |
| 5,911,808 | A | 6/1999 | Mendenhall | |
| 5,992,287 | A | 11/1999 | Dube | |
| 6,047,625 | A | 4/2000 | Mendenhall | |
| 6,148,702 | A | 11/2000 | Bucks | |
| 6,557,260 | B1 | 5/2003 | Morris | |
| 6,558,725 | B2 | 5/2003 | Giraldo et al. | |
| RE38,149 | E | 6/2003 | Dube et al. | |
| 6,725,765 | B1 | 4/2004 | Mendenhall | |
| D492,467 | S | 7/2004 | Pittard et al. | |
| 6,799,495 | B2 | 10/2004 | Jensen | |
| 7,073,260 | B2 | 7/2006 | Jensen | |
| 7,159,320 | B2 | 1/2007 | Moore | |
| D577,176 | S * | 9/2008 | Young | D1/128 |
| D581,627 | S * | 12/2008 | Young | D1/123 |
| 7,513,450 | B2 * | 4/2009 | Young | B26D 1/0006 241/282.1 |
| 7,568,414 | B2 | 8/2009 | Farid et al. | |
| D640,036 | S | 6/2011 | Walker et al. | |
| 8,104,391 | B2 | 1/2012 | McCracken et al. | |
| 8,347,511 | B2 | 1/2013 | Young et al. | |
| D688,437 | S | 8/2013 | Walker et al. | |
| 9,089,987 | B2 | 7/2015 | Walker et al. | |
| 2001/0042428 | A1 | 11/2001 | Jensen | |
| 2003/0072835 | A1 | 4/2003 | Weinstein et al. | |
| 2003/0232116 | A1 | 12/2003 | Fein et al. | |
| 2004/0093738 | A1 | 5/2004 | Mauro | |
| 2005/0000344 | A1 | 1/2005 | Bucks | |
| 2005/0102843 | A1 | 5/2005 | Jiang | |
| 2006/0283339 | A1 | 12/2006 | Jensen et al. | |
| 2007/0215736 | A1 | 9/2007 | Young et al. | |
| 2007/0264418 | A1 * | 11/2007 | Young | B26D 1/0006 426/637 |
| 2008/0011165 | A1 | 1/2008 | Justesen et al. | |
| 2008/0134850 | A1 | 6/2008 | Bates et al. | |
| 2012/0024125 | A1 | 2/2012 | Walker et al. | |
| 2013/0087032 | A1 | 4/2013 | Walker et al. | |

FOREIGN PATENT DOCUMENTS

| | | | |
|---|---|---|---|
| CN | 2530563 | Y | 1/2003 |
| CN | 2827517 | Y | 10/2006 |
| CN | 202037612 | U | 11/2011 |
| CN | 203831461 | U | 9/2014 |
| CN | 105875022 | A | 8/2016 |
| DE | 811606 | C | 8/1951 |
| DE | 1876145 | U | 7/1963 |
| DE | 69313804 | T2 | 1/1998 |
| EP | 583412 | A1 | 2/1994 |
| EP | 2766154 | A1 | 8/2014 |
| EP | 3192619 | A1 | 7/2017 |
| FR | 549882 | A | 2/1923 |
| FR | 2500782 | A1 | 9/1982 |
| JP | 496167 | A | 1/1974 |
| JP | 2004025421 | A | 1/2004 |
| JP | 2005262361 | A | 9/2005 |
| JP | 4104168 | B2 | 6/2008 |
| KR | 2019990020541 | U | 6/1999 |
| KR | 1020060134943 | A | 12/2006 |
| NL | 9200863 | A | 12/1993 |
| WO | 9201392 | A1 | 2/1992 |
| WO | 9954098 | A1 | 10/1999 |
| WO | 2007062533 | A1 | 6/2007 |
| WO | 2010/105355 | A1 | 9/2010 |

OTHER PUBLICATIONS

Urschel Laboratories Incorporated, "TranSiicer 2000 Cutter: Precision Slicing with Maximum Versatility" Mar. 2005.

Urschel Laboratories Incorporated, "Velocicut Cutting Head: Strip Cutting Head", Jan. 2006.

Extended European Search Report. European Application No. 15161631.5, dated Aug. 18, 2015.

Chinese Office Action ( Search Report with English Translation). Chinese Application No. 2015101528175, dated Jun. 1, 2016.

Chinese First OfficeAction (with English Translation). Chinese Application No. 2015101528175, dated Jun. 12, 2016.

Chinese Second Office Action (with English Translation).Chinese Application No. 2015101528175, dated Feb. 4, 2017.

Chinese Third Office Action (with English Translation). Chinese Application No. 2015101528175, dated Aug. 22, 2017.

Document relating to European Application No. Notice of opposition to a European Patent No. 15161631.5. Dated: May 23, 2018 (Notice of opposition to a European patent).

EPO Brief Communication. Jul. 19, 2019 Letter from Opponent: Written submissions in preparation to oral proceedings. EP application No. 15161631.5 (granted as EP2926962). 46 pages.

* cited by examiner

BLADE ASSEMBLY AND FOOD CUTTING DEVICE INCORPORATING THE SAME

CROSS REFERENCE TO RELATED APPLICATIONS

This application is a continuation of U.S. patent application Ser. No. 14/242,232, filed Apr. 1, 2014, which is incorporated by reference herein in its entirety.

FIELD

This application relates to the field of cutting food products, such as fruit or vegetables.

INTRODUCTION

This application relates to blade assemblies for making cut food products. More particularly, this application relates to blade assemblies comprising a plurality of blades which are twisted along their length.

SUMMARY

In a first aspect, a blade assembly is provided. The blade assembly may comprise a mounting ring, at least two elongate cutting blades, and a substantially circular central support positioned substantially at the center of the mounting ring. Each cutting blade may have a proximal end connected to the mounting ring. Each cutting blade may extend from the mounting ring toward a center of the mounting ring. Each cutting blade may be twisted along a length of the cutting blade. A distal end of each cutting blade may be connected to the central support.

In some embodiments, each cutting blade may be held in tension between the mounting ring and the central support.

In some embodiments, for each cutting blade, the mounting ring may include a recess for receiving the proximal end of the cutting blade and the cutting blade may be positionable along the recess to adjust a tension in the blade.

In some embodiments, the proximal end of each cutting blade may be connected to a tension block, each tension block may be connected to the mounting ring by a fastener, and actuating the fastener may cause the tension block to slide within the recess, thereby changing the tension of the corresponding blade.

In some embodiments, the mounting ring may include a plurality of circumferentially spaced apart recesses, each recess may be adapted to receive a corresponding tension block, and each tension block may include a channel for receiving a post extending from the corresponding recess. The post may be adapted to travel along the channel when the tension block slides within the recess.

In some embodiments, a pin may be connected to the distal end of each blade, and each pin may be received in a corresponding slot of the central support.

In some embodiments, each cutting blade may be integrally molded with the mounting ring.

In some embodiments, the blade assembly may further comprise at least one slitter blade. Each slitter blade may extend upstream from an upstream side one of the cutting blades or downstream from a downstream side of one of the cutting blades.

In some embodiments, at least two slitter blades may extend from one of the cutting blades.

In some embodiments, each cutting blade may be integrally formed with a portion of the central support.

In some embodiments, the at least two cutting blades may comprise at least one pair of two radially adjacent cutting blades. The two cutting blades of each pair of cutting blades may be integrally formed.

In some embodiments, the two cutting blades of each pair of cutting blades may be joined by a corresponding bent distal portion, each bent distal portion may be received in the central support, and each cutting blade in each pair of cutting blades may extend from the corresponding bent distal portion through a corresponding slot in the central support.

In some embodiments, for each pair of two cutting blades, there may be a curved connecting member joining the distal ends of the two cutting blades.

In some embodiments, the substantially circular central support may be a combination of the connecting members of each pair of cutting blades.

In some embodiments, for each cutting blade, the mounting ring may include an angled mounting surface to which a proximal portion of that cutting blade is connected.

In some embodiments, an inclination of the upstream edge of each cutting blade and a line representing the direction of flow may define an angle of attack therebetween, and for each cutting blade, the angle of attack may decrease between the cutting blade's proximal end and the cutting blade's distal end.

In some embodiments, for each cutting blade, the angle of attack may decrease from a first angle of attack at the proximal end of the cutting blade to a second angle of attack at the distal end of the cutting blade. The second angle of attack may be smaller than the first angle of attack. The first angle of attack may be in the range of about 15 to 90 degrees. The second angle of attack may be in the range of about 0 to 80 degrees.

In some embodiments, each cutting blade may be corrugated.

In some embodiments, each cutting blade may be equally spaced apart from each radially adjacent cutting blade.

In some embodiments, the mounting ring may be adapted to rotate.

In another aspect, a food cutting device is provided. The food cutting device may comprise a housing defining a cavity, a blade assembly received in the cavity, and a cover plate overlying the blade assembly and removably secured to the housing. The blade assembly may comprise a mounting ring, at least two elongate cutting blades, and a substantially circular central support positioned substantially at the center of the mounting ring. Each cutting blade may have a proximal end connected to the mounting ring. Each cutting blade may extend from the mounting ring toward a center of the mounting ring. Each cutting blade may be twisted along a length of the cutting blade. A distal end of each cutting blade may be connected to the central support.

The food cutting device may further comprise a motor drivingly coupled to the blade assembly for rotation of the blade assembly inside the cavity.

In some embodiments, the motor may further comprise an output shaft, and the food cutting device may further comprise a belt coupling the output shaft to the blade assembly.

The food cutting device may further comprise bearings coupled to the blade assembly.

In some embodiments, each of the housing and the cover plate include an opening aligned with the center of the mounting ring and sized to permit food to pass through the cutting blades.

In some embodiments, each cutting blade may be integrally formed with a portion of the central support.

DRAWINGS

DESCRIPTION OF VARIOUS EMBODIMENTS

Numerous embodiments are described in this application, and are presented for illustrative purposes only. The described embodiments are not intended to be limiting in any sense. The invention is widely applicable to numerous embodiments, as is readily apparent from the disclosure herein. Those skilled in the art will recognize that the present invention may be practiced with modification and alteration without departing from the teachings disclosed herein. Although particular features of the present invention may be described with reference to one or more particular embodiments or figures, it should be understood that such features are not limited to usage in the one or more particular embodiments or figures with reference to which they are described.

The terms "an embodiment," "embodiment," "embodiments," "the embodiment," "the embodiments," "one or more embodiments," "some embodiments," and "one embodiment" mean "one or more (but not all) embodiments of the present invention(s)," unless expressly specified otherwise.

The terms "including," "comprising" and variations thereof mean "including but not limited to," unless expressly specified otherwise. A listing of items does not imply that any or all of the items are mutually exclusive, unless expressly specified otherwise. The terms "a," "an" and "the" mean "one or more," unless expressly specified otherwise.

For convenience, the description below will refer to potatoes as the food product being cut. Those skilled in the art will appreciate that the embodiments of the blade assembly and food cutting device described herein may be used to cut any suitable product, including without limitation food products (such as fruit and vegetables), wood, and fibrous materials (such as bamboo).

Figure 1:
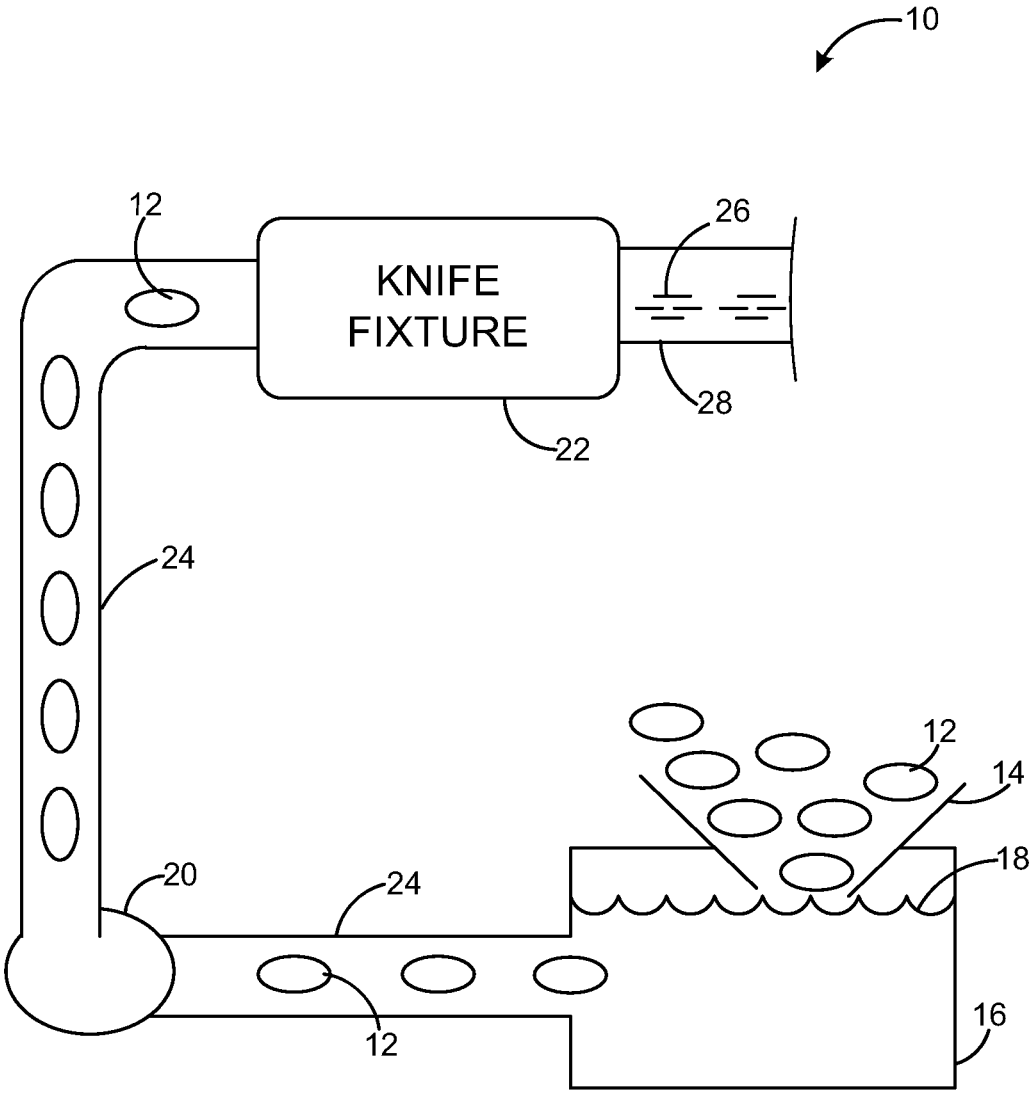
FIG. 1 shows a schematic diagram of a hydraulic cutting system, in accordance with at least one embodiment.

FIG. 1 shows a schematic view of a hydraulic cutting system 10, in accordance with at least one embodiment. In the example shown, potatoes 12 are fed from a hopper 14 into a tank 16 in which they are submersed in water 18. As shown, a plurality of conduits 24 connect tank 18 to a pump 20, and pump 20 to a knife fixture 22.

In some embodiments, pump 20 circulates water 18 from tank 16 to thereby entrain potatoes 12 to travel through conduits 24 to knife fixture 22. In some examples, conduits 24 are sized to receive potatoes 12 in single file. For example, conduits (e.g. pipes) 24 may have a diameter that is greater than a diameter of potatoes 12, and less than the diameter of two potatoes 12. In alternative embodiments, conduits 24 may be sized to receive two or more potatoes 12 in parallel. For example, conduits 24 may have a diameter that is greater than a diameter of at least two potatoes 12.

In the example shown, potatoes 12 travel through conduits 24 toward knife fixture 22 at a velocity imparted to them by pump 20. Knife fixture 22 includes blade assembly 100 (not shown in FIG. 1) described in detail below. As potatoes 12 travel through knife fixture 22, they are cut into smaller pieces 26 and discharged through outlet conduit 28. Optionally, smaller pieces 26 are subjected to subsequent processing (e.g. cooking, parfrying, freezing, packaging etc.). In some embodiments, potatoes 12 are raw potatoes, and smaller pieces 26 are processed into French fries. Knife fixture 22 includes a food cutting device 200, which in turn includes a blade assembly 100 as described in more detail below.

Figure 2:
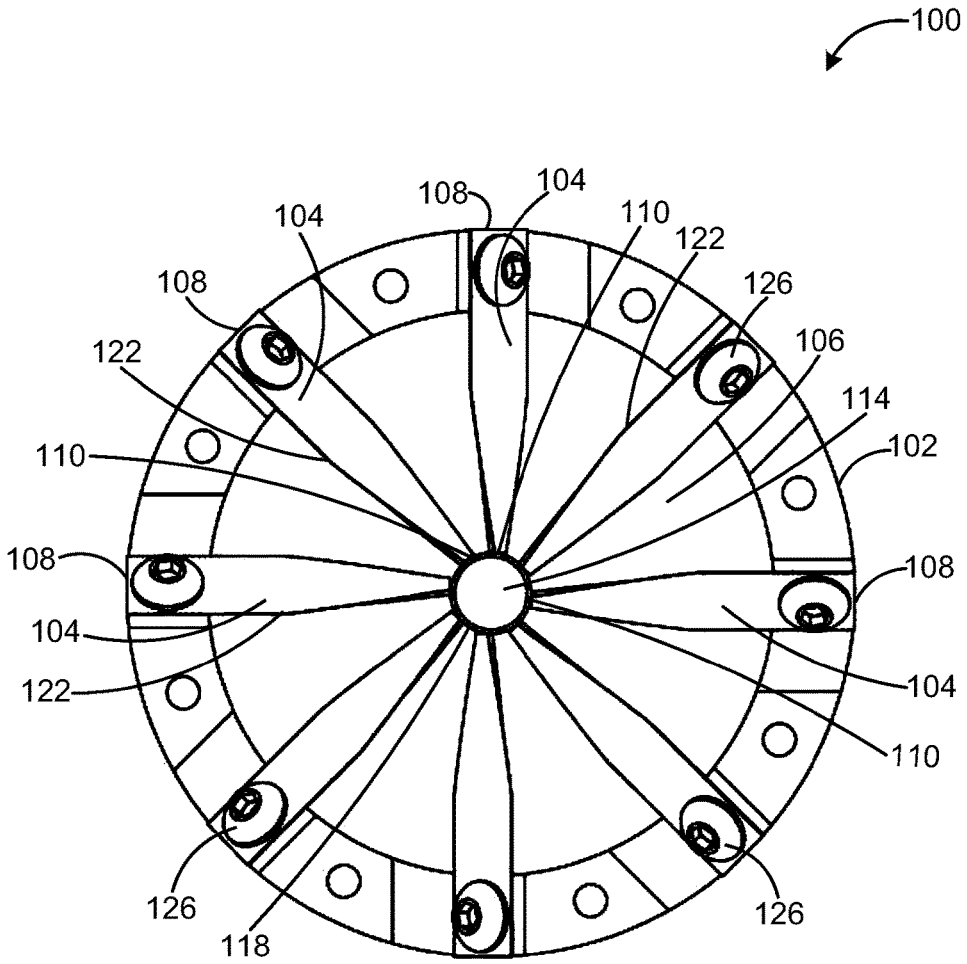
FIG. 2 shows a top plan view of a blade assembly, in accordance with at least one embodiment.
Figure 3:
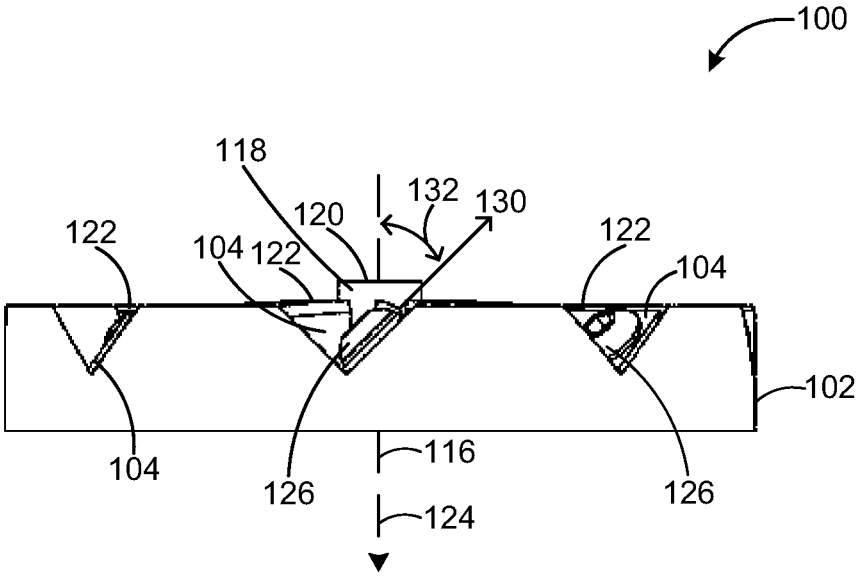
FIG. 3 shows a side elevation view of the blade assembly of FIG. 2.
Figure 4:
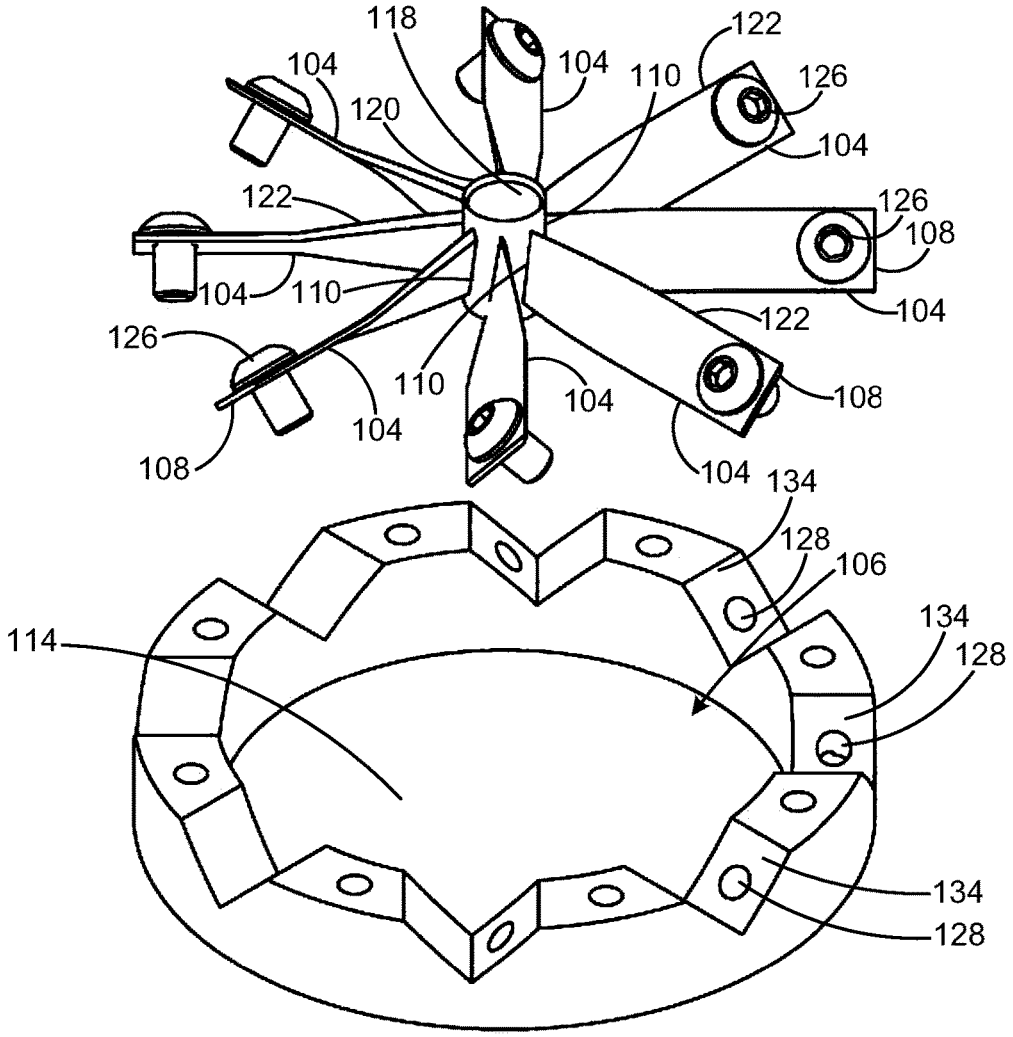
FIG. 4 shows an exploded perspective view of the blade assembly of FIG. 2.

Referring to FIGS. 2-4, blade assembly 100 includes a mounting ring 102 for carrying one or more cutting blades 104. As shown, mounting ring 102 defines a circular opening 106 for receiving one or more potatoes in succession. Each cutting blade 104 includes a proximal end 108 and a distal end 110 (proximal and distal ends 108 and 110 are marked on a subset of the cutting blades 104 shown to avoid cluttering the figures). The proximal end 108 of each cutting blade 104 is secured to the mounting ring 102, as described in more detail below. Each cutting blade 104 extends from the mounting ring 102, across a portion of opening 106, toward a center 114 of mounting ring 102. The cutting blades 104 are thus positioned in the opening 106 for contacting potatoes that pass through opening 106. For example, when a potato is propelled through opening 106, the potato may impact one or more of cutting blades 104 and thereby be cut into two or more slices.

Cutting blades 104 may be made from any suitable material. For example, cutting blades 104 may be made from a food grade metal (e.g. stainless steel) or ceramic material. Optionally, cutting blades 104 may be hardened, such as by cold working or by applying heat treatment.

Preferably, blade assembly 100 is a rotary cutting fixture for cutting food into twisted wedges. Generally, a relative rotation between blades 104 and a potato passing through opening 106, may be provided to permit each blade 104 to cut the potato along a curved path to produce twisted wedges. In one example, blade assembly 100 is mounted to a bearing assembly for rotation about an axis 116 which extends through center 114. Alternatively, or in addition, a rotation may be imparted to potatoes that are projected toward opening 106. For example, blade assembly 100 may be stationary.

Continuing to refer to FIGS. 2-4, blade assembly 100 includes a central support 118 connected to one or more of blades 104. Central support 118 has a substantially circular cross-section that is aligned with and surrounds center 114 and axis 116. In some examples, central support 118 is substantially cylindrical in shape. Distal end 110 of each blade 104 is connected to central support 118. Distal end 110 of each blade 104 may be connected to central support 118 in any suitable fashion, such as by a weld, adhesive, or by integrally molding the blade 104 and central support 118. When a potato passes through opening 106, central support 118 may core the potato while blades 104 divide the potato into slices. In some cases, central support 118 may be useful for removing an undesirable core from some foods (e.g. apples, and pears).

Central support 118 may also facilitate maintaining the alignment of the potato as the potato passes through opening 106 and it is sliced into wedge-shaped pieces (also referred to herein as "wedges") by blades 104. In some cases, it may be desirable to maintain a potato's longitudinal axis aligned with the direction 124 of flow (which is normally parallel to the axis of rotation 116) through opening 106. This may produce the longest wedges, which may be appealing to consumers. When the potato passes through opening 106, central support 118 carves out a cylindrical core of the potato. Once formed, the cylindrical core may still be attached to the remainder of the potato, and then travels through the straight cylindrical body of central support 118. The close fit between the core and the cylindrical body of central support 118 may substantially prevent the core (and the remainder of the potato connected thereto) from rotating out of alignment with the direction 124 of flow.

As best shown in FIG. 3, an upstream end 120 of central support 118 may extend further upstream than the upstream edges 122 of blades 104 (edges 122 are labeled on a subset of blades 104 to avoid cluttering the figures). This may permit central support 118 to fix the alignment of the potato before the potato impacts blades 104. In some cases, blades 104 may exert forces upon the potato that might urge the potato to rotate out of alignment with the direction 124 of flow. In alternative embodiments, upstream end 120 may be level with or downstream of upstream edges 122.

Preferably, upstream end 120 of central support 118, and upstream edges 122 of blades 104 are sharpened to help cut through potatoes. In alternative embodiments, one or more of upstream edges 122 and upstream end 120 is unsharpened. In some examples, one or more of central support 118 and blades 104 is not sharpened. For example, one or more of central support 118 and blades 104 may be sufficiently thin to slice potatoes without sharpening.

Referring again to FIGS. 2-4, blade assembly 100 may include two or more cutting blades 104. Blade assembly 100 may divide a potato into a number of wedges equal to the number of blades 104. The size of each wedge depends in part on the distance between radially adjacent blades 104. As used herein, and in the claims, a "radially adjacent blade" means the next closest blade in either a clockwise or counter-clockwise direction about center 114. In the example shown, blade assembly 100 includes eight blades 104 and the spacing between radially adjacent blades is equal. In alternative embodiments, blade assembly 100 may include between 2 and 20 blades. Further, the spacing between some radially adjacent blades may be unequal in some embodiments. Including different spacing between pairs of radially adjacent blades may provide variety to the widths of potato wedges cut by blade assembly 100. Such variety in widths may provide a more natural "home cut" appearance.

In the example shown, each blade 104 is twisted along its length. This may permit blades 104 to more cleanly cut a potato along curved paths to produce twisted wedges. As shown, an inclination 130 of the upstream edge 122 of each blade 104 varies along the blade's length. The angle between the line representing the direction of flow and the inclination 130 of a particular point on the length of the blade is referred to as the angle of attack 132. The angle of attack 132 also varies along each blade's length. In the example shown, angle of attack 132 of each blade 104 decreases from the blade's proximal end 108 to the blade's distal end 110. In other words, blades 104 are shown twisting from the proximal end 108 to the distal end 110 toward the upstream direction. In the example shown, angle of attack 132 is nearly 0° at distal end 110 where blade 104 is connected to central support 118.

In the example shown, each blade 104 twists substantially continuously along its length. In alternative embodiments, one or more blades 104 twist discontinuously along their length. In an alternative embodiment (not shown), blade 104 may have a proximal portion and distal portion, and the inclination 130 of the upstream edge 122 is constant but different for each portion.

Preferably, angle of attack 132 varies from about 45 degrees at the proximal end 108 to about 5 degrees at the distal end 110. In alternative embodiments, angle of attack 132 at the proximal end 108 may be in the range of between about 15 and about 90 degrees. In such embodiments, angle of attack 132 at the distal end 110 is smaller than the angle at the proximal end, and may be in the range of between about 0 and 80 degrees. Generally, cutting blades 104 that are more twisted along their length may cut wedges that are more twisted, and vice versa. In some embodiments, one or more blades 104 may include no twist at all.

Continuing to refer to FIGS. 2-4, each cutting blade 104 is connected adjacent its proximal end 108 to mounting ring 102 by a fastener 126 (a subset of fasteners 126 are labeled to avoid cluttering the figures). In some embodiments, fasteners 126 can be disengaged to allow blades 104 to be removed for repair or replacement (e.g. in the case of damage or dulling). Alternatively, fastener 126 may permanently attach blade 104 to mounting ring 102. In the example shown, each fastener 126 is a screw which extends through a hole (not shown) in a blade 104 and a corresponding hole 128 in mounting ring 102. In alternative embodiments (not shown), each blade 104 may be secured to mounting ring 102 in any other suitable manner, such as by a rivet, a weld, a bolt, a nail, adhesive, or by integrally molding the blade and the mounting ring 102.

The mounting ring 102 includes an angled mounting surface 134 for each blade 104. As shown, each mounting surface 134 is formed at a slope that permits the distal portion of a blade 104 to lie flat against it.

Figure 5:
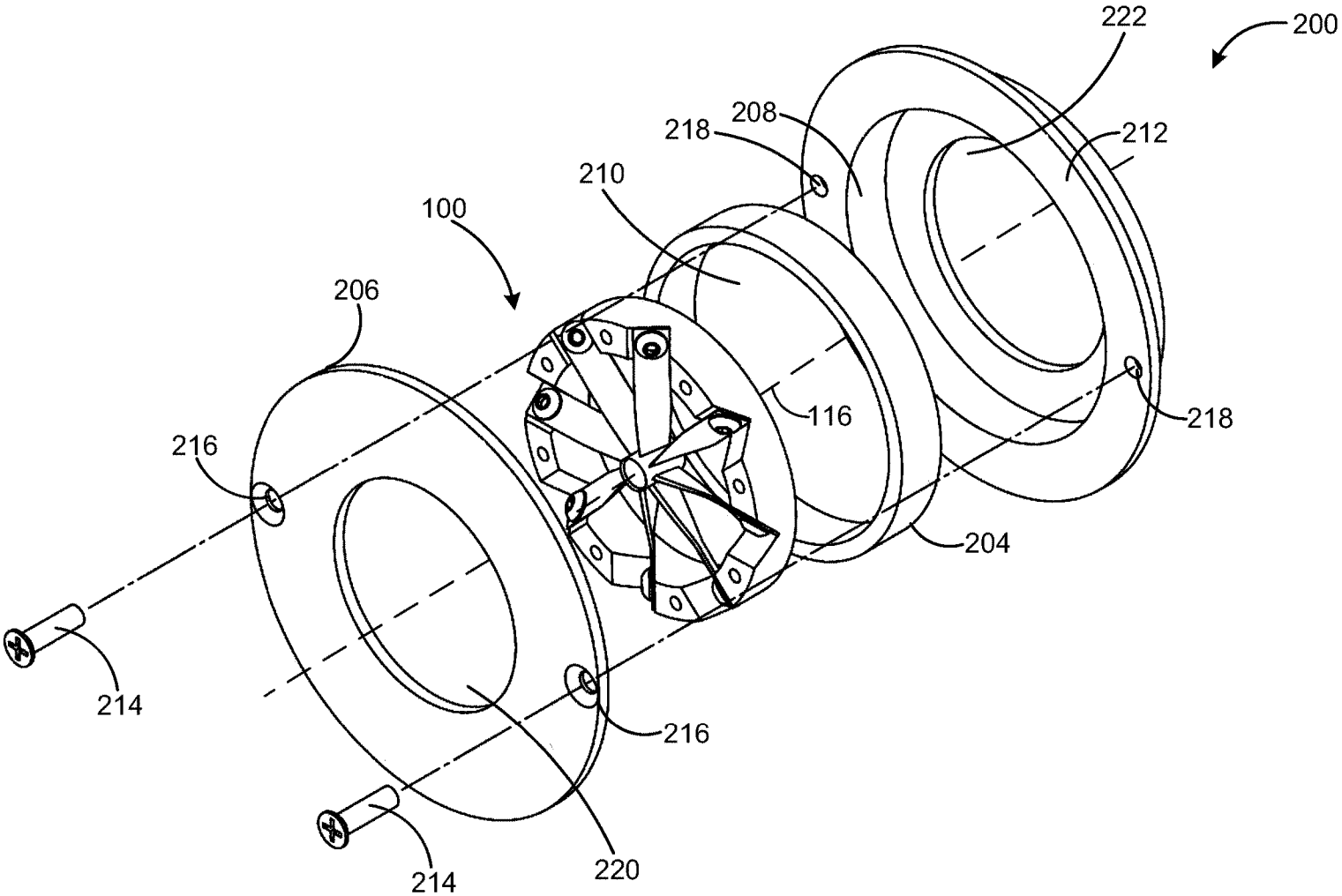
FIG. 5 shows an exploded perspective view of a food cutting device, including the blade assembly of FIG. 2, in accordance with at least one embodiment.

FIG. 5 shows an exploded perspective view of a bearing assembly 200 with a blade assembly 100 mounted therein, in accordance with at least one embodiment. The bearing assembly 200 includes a housing 202, bearings 204, and a cover plate 206. As shown, housing 202 defines a cavity 208 sized to receive bearings 204, which are schematically illustrated. In turn, bearings 204 define an interior opening 210 for receiving blade assembly 100. Bearings 204 may permit blade assembly 100 to rotate about axis 116 relative to housing 202 with little or no frictional resistance. In some examples, bearings 204 are roller bearings, magnetic bearings, slip bearings, sleeve bearings, or fluid bearings.

In the example shown, cover plate 206 is sized to secure to a flange 212 of housing 202 and overlap a portion of blade assembly 100. This may permit cover plate 206 to retain blade assembly 100 inside cavity 208. As shown, bearing assembly 200 includes a plurality of housing fasteners 214, each of which extends through an opening 216 in cover plate 206 and an opening 218 in housing 202 to secure cover plate 206 to housing 202. In alternative embodiments, cover plate 206 may be secured to housing 202 in any other suitable fashion, such as with bolts, nails, rivets, or welds.

Continuing to refer to FIG. 5, cover plate 206 includes an opening 220 and housing 202 includes an opening 222. Openings 220 and 222 are preferably sized to receive a potato, and are aligned with opening 106 of blade assembly 100. This may permit a potato to enter bearing assembly 200 through opening 220, to pass through opening 106 of blade assembly 100, and to exit as a plurality of wedge slices through opening 222.

Figure 13:
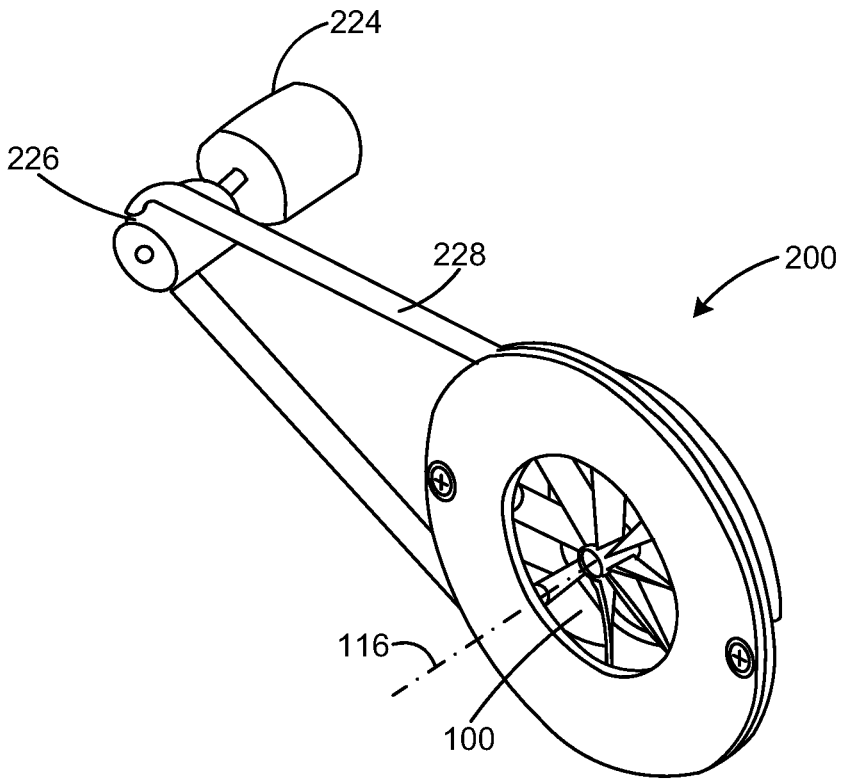
FIG. 13 shows a perspective view of a motor-driven food cutting device, in accordance with at least one embodiment.

Reference is now made to FIG. 13 which shows a motor driven food cutting device 200. As shown, a motor 224 includes an output shaft 226 that drives a belt 228. Belt 228 extends through openings (obscured from view) in food cutting device 200 and connects to blade assembly 100. In use, motor 224 can be activated to rotate output shaft 226 to drive belt 228. In turn, belt 228 rotates blade assembly 100 about axis of rotation 116. In other embodiments, motor 224 may drive blade assembly 100 in any other suitable fashion, such by gears or a chain instead of belt 228.

Alternatively or in addition, blade assembly 100 may be configured to rotate by the kinetic energy of the liquid (e.g. water) flowing through blades 104, like a turbine. Further, in some cases, the impacts of potatoes against blades 104 may further accelerate the rotation of blades 104.

Figure 6:
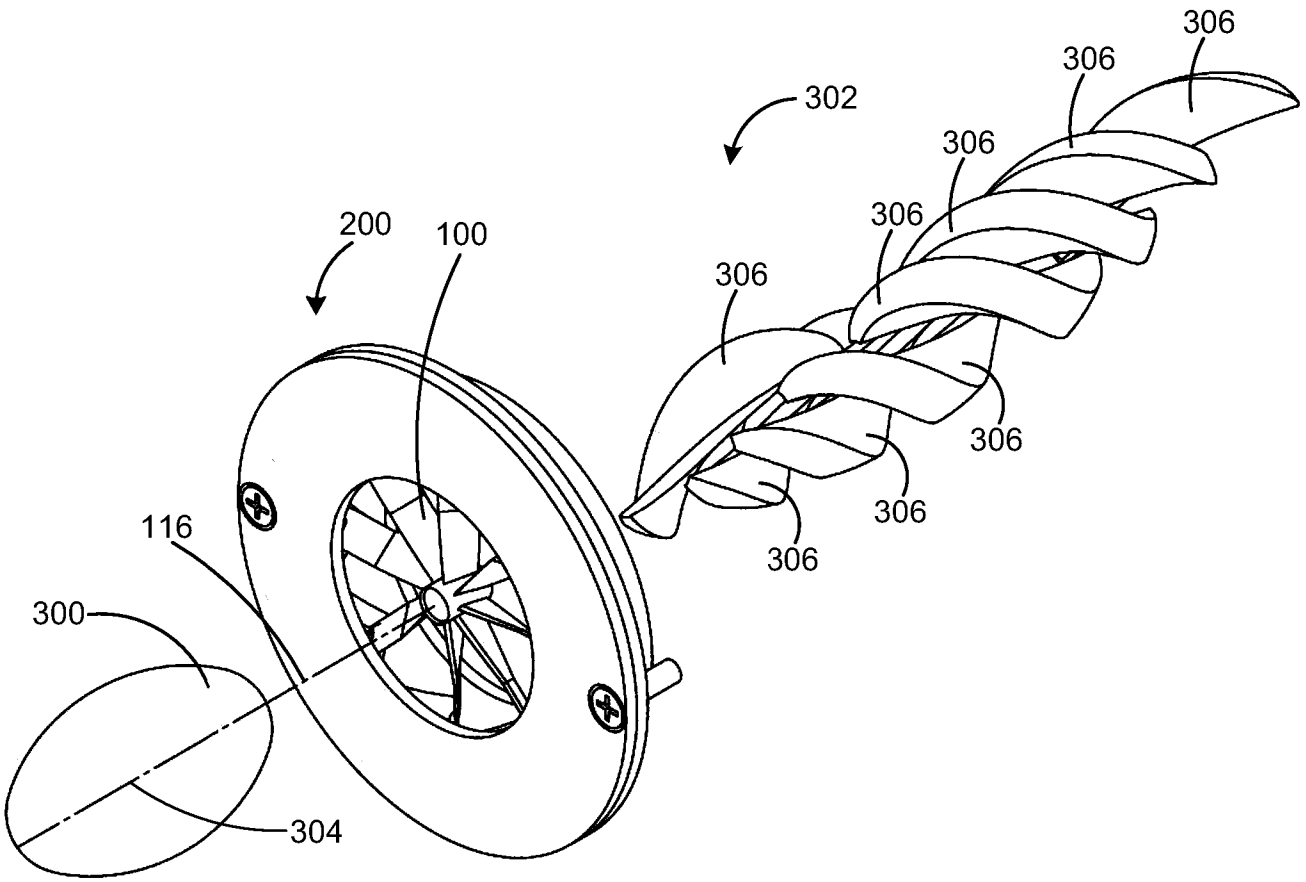
FIG. 6 shows a perspective view of the food cutting device of FIG. 5, a potato before slicing, and a potato after slicing.

FIG. 6 shows a perspective view of bearing assembly 200, a potato 300 before slicing, and a potato 302 after slicing. In the example shown, potato 300 is traveling toward blades 104 of blade assembly 100 with the longitudinal axis 304 of the potato 300 aligned with the axis of rotation 116 of blade assembly 100. In alternative embodiments, potato 300 may be projected at blades 104 with its longitudinal axis 304 misaligned with axis of rotation 116.

In the example shown, when a potato 300 passes through the rotating blades 104 of blade assembly 100, a sliced potato 302 is produced. As shown, potato 302 has been sliced into a plurality of potato pieces 306 and the core (not shown) has been carved out by central support 118.

Figure 7:
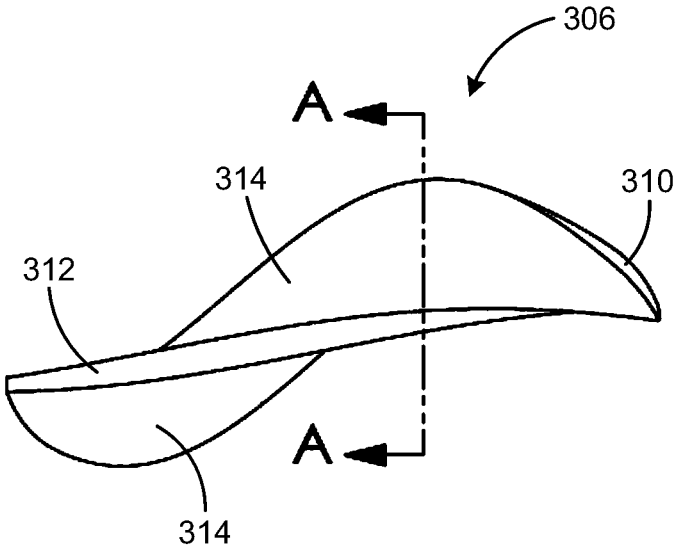
FIG. 7 shows a front elevation view of a potato piece, in accordance with at least one embodiment.
Figure 8:
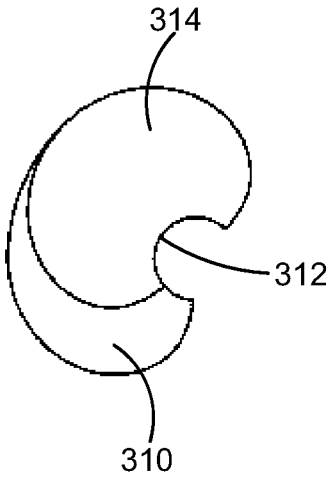
FIG. 8 shows a side elevation view of the potato piece of FIG. 7.
Figure 9:
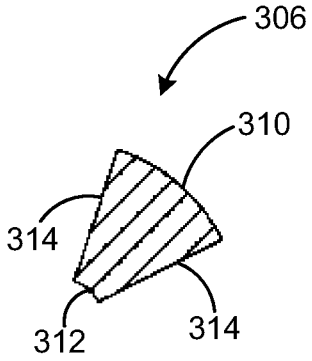
FIG. 9 shows a cross-sectional view taken along line A-A in FIG. 7.

Reference is now made to FIGS. 7-9. FIG. 7 shows a front elevation view of a potato piece 306, in accordance with at least one embodiment. FIG. 8 shows a side elevation view of potato piece 306. FIG. 9 shows a cross-sectional view of potato piece 306 taken along line A-A in FIG. 7. In the example shown potato piece 306 has a naturally formed outer surface 310, an inner surface 312 cut by central support 118, and two side surfaces 314 each cut by a blade 104. As shown, potato piece 306 is a twisted wedge that twists along its length. In some embodiments, inner surface 312 may be more durable than a sharp apex (e.g. produced by intersecting blades 104 of a blade assembly 100 without a central support 118) which may be prone to breaking or crumbling.

Figure 10:
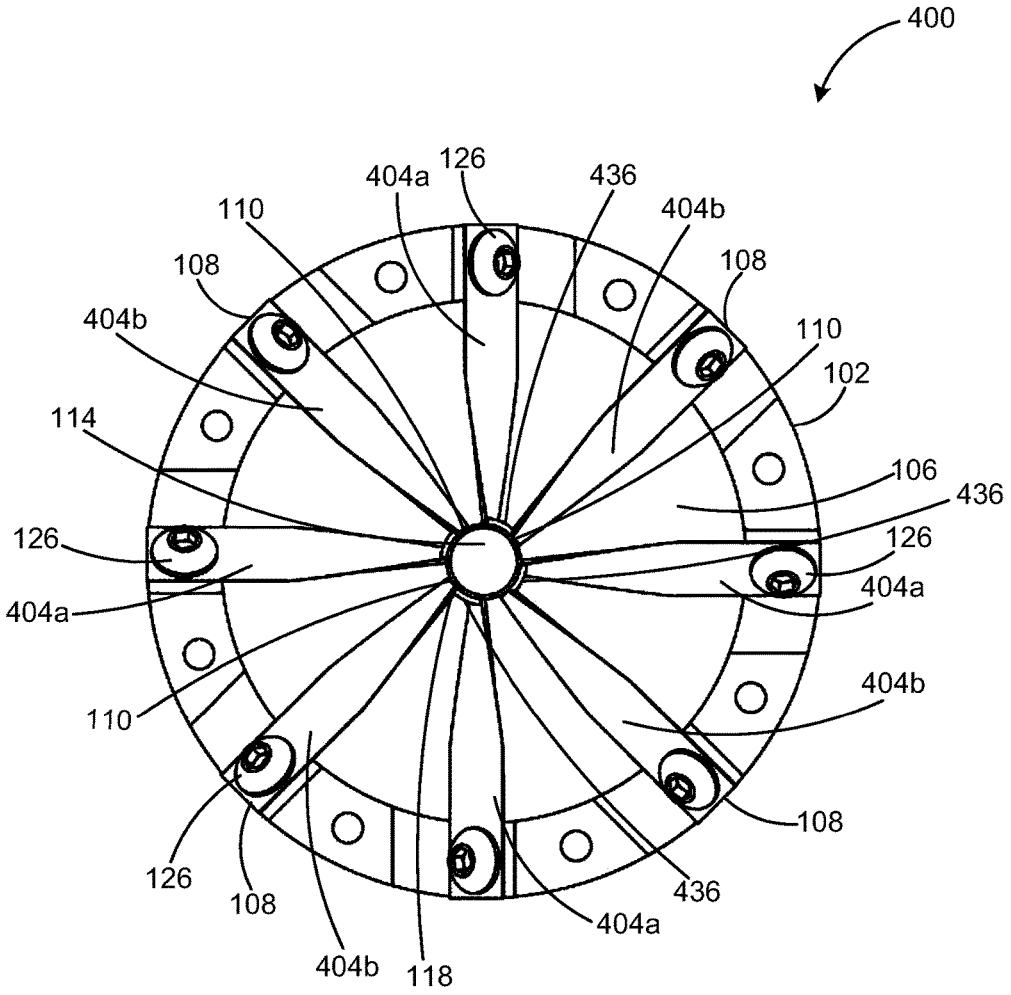
FIG. 10 shows a top plan view of a blade assembly, in accordance with another embodiment.
Figure 11:
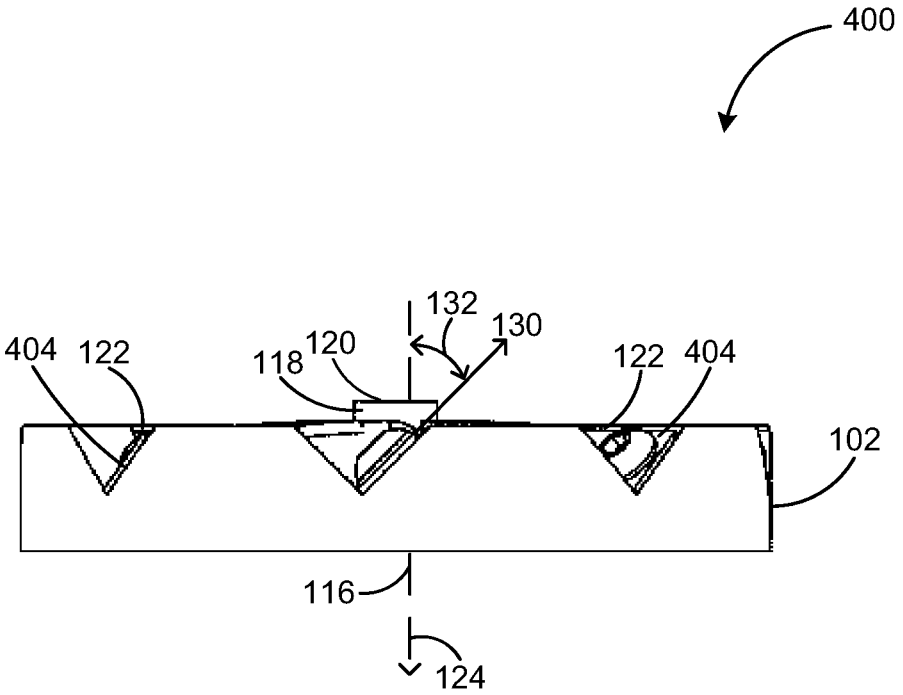
FIG. 11 shows a front elevation view of the blade assembly of FIG. 10.
Figure 12:
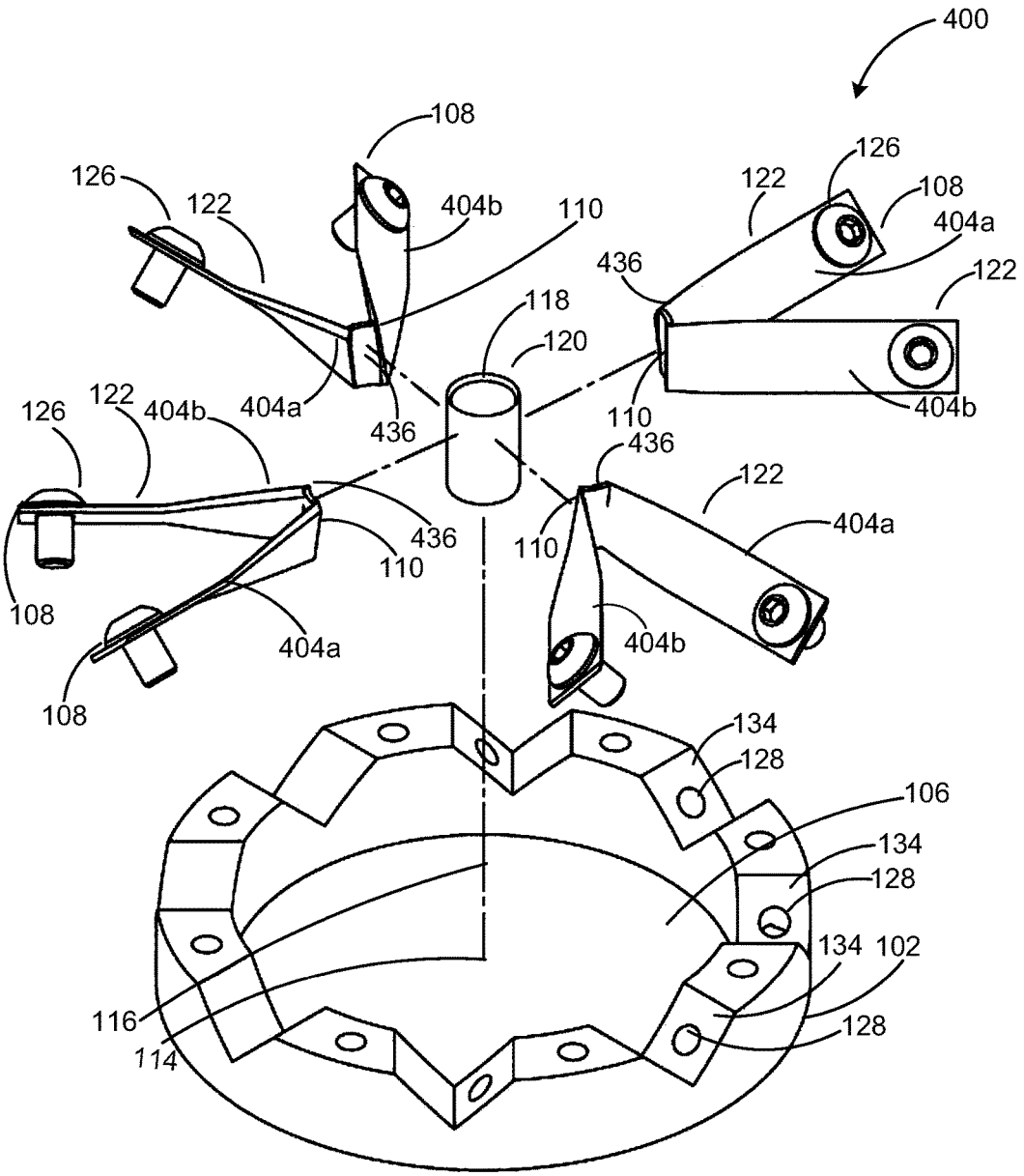
FIG. 12 shows an exploded perspective view of the blade assembly of FIG. 10.

Reference is now made to FIGS. 10-12 where like part numbers refer to like parts in the previous figures, where a blade assembly 400 in accordance with another embodiment is shown. Blade assembly 400 is similar to blade assembly 100 in many respects except, for example, the structure of blades 404.

In the example shown, blades 404 of blade assembly 400 include a plurality of pairs of radially adjacent blades **404*a* and 404*b*. As shown, within each pair of blades, each blade 404 is substantially similar to blades 104 of blade assembly 100. For example, each blade 404 may be twisted along its length and secured to mounting ring 102 in the same manner as blades 104. However, blades 404 differ from blades 104** in that they are arranged in integrally formed pairs of blades 404*a* and 404*b* that are joined by a curved connecting member 436.

Each connecting member 436 is secured to central support 118. Each connecting member 436 has a semi-cylindrical shape that conforms to a portion of the exterior of central support 118. This may permit connecting members 436 to be positioned flush against central support 118. Otherwise, segments of potato may become lodged in the gaps formed between connecting members 436 and central support 118. In alternative embodiments, there may be gaps formed between connecting members 436 and central support 118. For example, connecting members 436 may be shaped differently than the exterior profile of central support 118.

In an alternative embodiment (not shown), blade assembly 100 may not include a discrete central support 118. Instead, connecting members 436 collectively form a substantially cylindrical central support. In this case, each blade 404 is integrally formed with a portion of the cylindrical central support provided by connecting member 436 to which it is joined. In some examples, connecting members 436 extend at least partially across the space between adjacent pairs of blades 404. This may permit connecting member 436 to reduce the gaps in the substantially cylindrical central support that they form.

Figure 14:
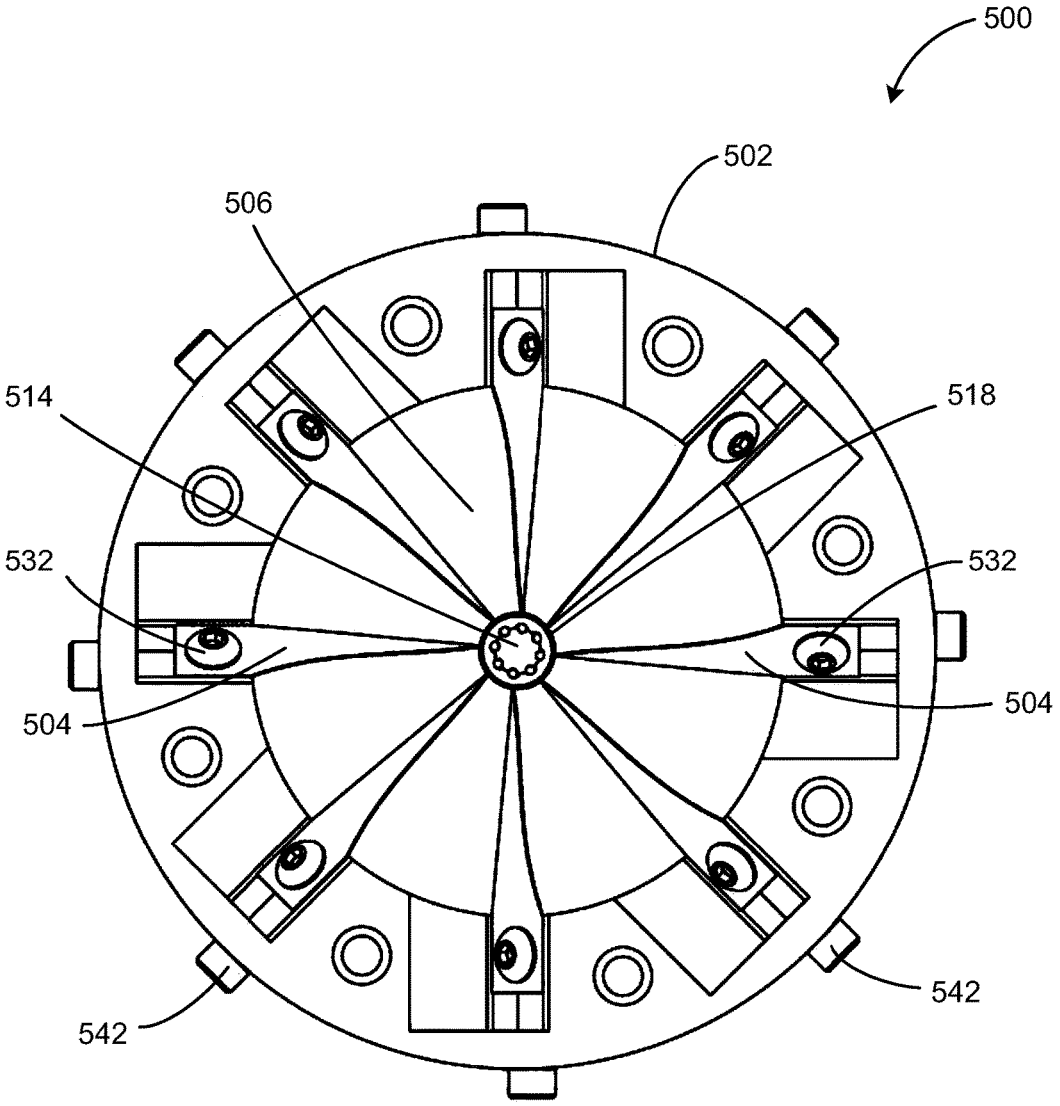
FIG. 14 shows a top plan view of a blade assembly, in accordance with another embodiment.
Figure 15:
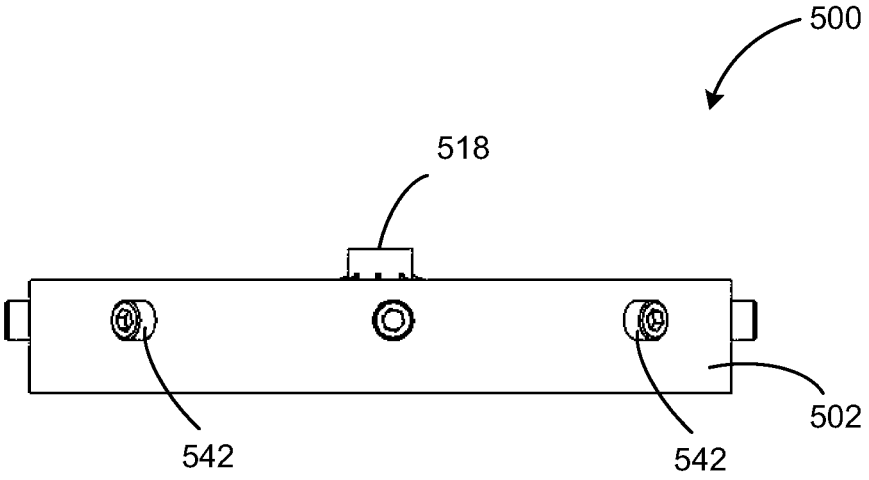
FIG. 15 shows a front elevation view of the blade assembly of FIG. 14.
Figure 16:
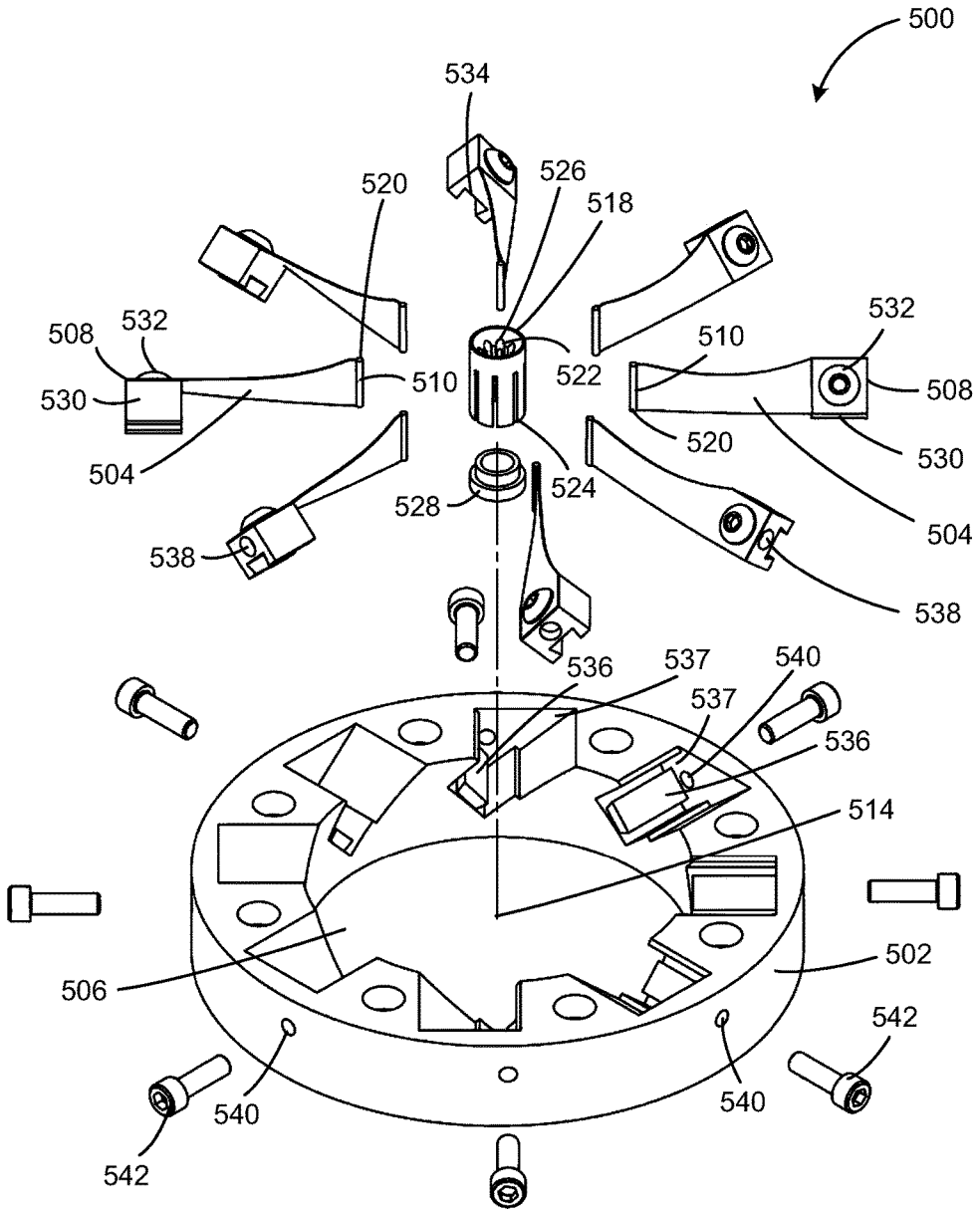
FIG. 16 shows an exploded perspective view of the blade assembly of FIG. 14.

Reference is now made to FIGS. 14-16 where a blade assembly 500 in accordance with another embodiment is shown. Blade assembly 500 includes a mounting ring 502 for carrying one or more cutting blades 504 (only two of the six cutting blades shown are labeled to avoid cluttering the figures). As shown, mounting ring 502 defines a circular opening 506 for receiving one or more potatoes in succession. Each cutting blade 504 includes a proximal end 508 and a distal end 510. The proximal end 508 of each cutting blade 504 is secured to mounting ring 502 as described in more detail below. Each cutting blade 504 extends from the mounting ring 502 across a portion of opening 506 toward a center 514 of mounting ring 502. The distal end 510 of each cutting blade 504 is connected to a central support 518.

In some embodiments, cutting blades 504 may be tension blades formed by thin flexible straps of metal. Preferably, each cutting blade 504 is held in tension between mounting ring 502 and central support 518 to enhance rigidity for cutting. For example, each cutting blade 504 may be connected to a fixed position on central support 518, and make a sliding connection with mounting ring 502 for adjusting the tension.

Distal end 510 of each cutting blade 504 is connected to central support 518 in a suitable manner. In the example shown, the distal end 510 of each cutting blade 504 includes a pin 520 that is received in a corresponding slot 522 of central support 518. Each slot 522 is shown including an open lower end 524 where the pin 520 may be inserted, and a closed upper end 526. A cap 528 connects to a lower end of central support 518 to close the lower ends 524 of slots 522 to retain pins 520 in slots 522. Preferably, cap 528 is removable to permit a blade 504 (e.g. that is dull or damaged) to be replaced. In alternative embodiments, the cutting blade 504 may be connected to central support 518 in another manner, such as by welds, adhesives, screws, bolts, or rivets.

Preferably, the proximal end 508 of each cutting blade 504 is connected to mounting ring 502 in a manner that permits the tension of each cutting blade 504 to be adjusted. In the example shown, each proximal end 508 is connected to a tension block 530 in any suitable manner, such as by a screw 532, welding, adhesive, or a rivet. Each tension block 530 is configured to make a sliding connection with mounting ring 502 for adjusting the tension of the connected blade 504. As shown, each tension block 530 includes a channel 534 sized to receive a corresponding post 536 of mounting ring 502. Each post 536 is located in a corresponding recessed portion 537 of the mounting ring 502. Preferably, each channel 534 and corresponding post 536 have corresponding shapes and the post 536 of the recessed portion is received in the channel 534 of the tension block 530, thereby permitting the tension block to slide along the recessed portion.

Preferably, each tension block 530 is securable in a position at a selected distance from central support 518 (corresponding to a desired tension). In the example shown, each tension block 530 includes a threaded hole 538 that aligns with a corresponding hole 540 of mounting ring 502. Tension block 530 can be urged away from central support 518 (increasing tension in the connected blade 504) by inserting a threaded fastener (e.g. bolt 542) through hole 540 into threaded hole 538 and tightening. Similarly, tension in the connected blade 504 may be reduced by loosening bolt 542.

Each blade 504 may be twisted along its length similarly to blades 104 of blade assembly 100. The extent to which blades 504 are twisted may substantially depend upon the angle at which blades 504 are connected to mounting ring 502 and central support 518. In the example shown, each post 536 is inclined relative to the upstream direction and when channels 534 of tension blocks 530 receive posts 536, tension blocks 530 maintain proximal ends 508 of blades 504 at a particular angle of attack. It will be appreciated that posts 536, channels 534, and/or tension blocks 530 more generally may be modified to adjust the angle of attack at proximal ends 508 of blades 504.

Each slot 522 of central support 518 is shown extending in parallel with the upstream direction. This may provide the distal ends 510 of blades 504 with a 0° angle of attack when distal ends 510 are connected to central support 518 by pins 520. It will be appreciated that the inclination of slots 522 may be modified to adjust the angle of attack at distal ends 510 of blades 504.

Figure 17:
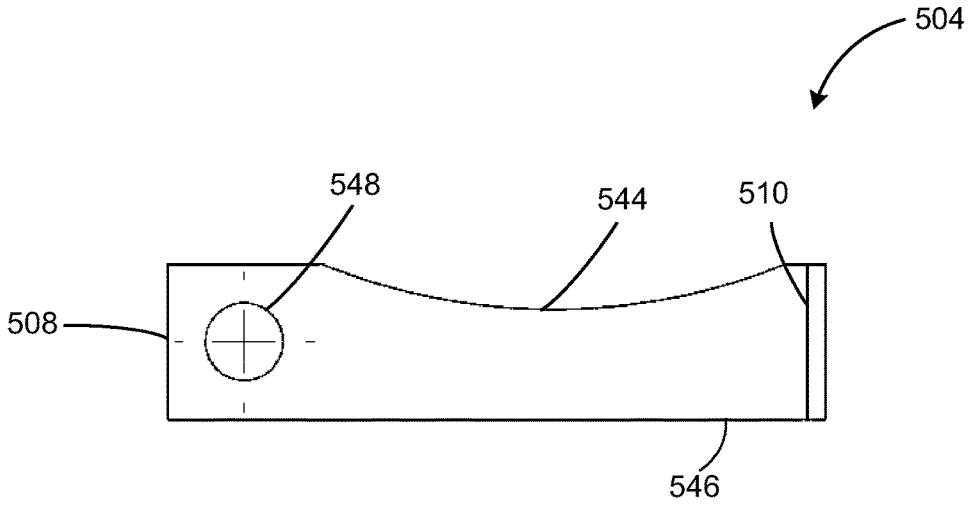
FIG. 17 shows a front elevation view of a cutting blade of the blade assembly of FIG. 14.
Figure 18:
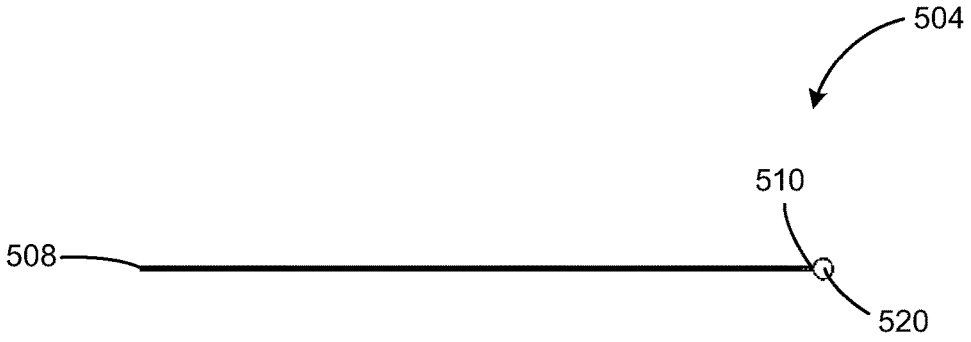
FIG. 18 shows a top plan view of the cutting blade of FIG. 17.

Reference is now made to FIGS. 17 and 18 which show an exemplary cutting blade 504. As shown, cutting blade 504 includes an upstream edge 544 opposite a downstream edge 546. In use, upstream edge 544 makes first contact with a potato and cuts the potato into segments. Optionally, upstream edge 544 may be sharpened. Alternatively, upstream edge 544 may be thin enough that sharpening is not required for the intended application. In the example shown, upstream edge 544 is concavely curved toward downstream edge 546 in the untwisted state shown. Alternatively, upstream edge 544 may be straight or have any other desired shape.

Blade 504 includes a through-hole 548 for receiving a fastener 532 that connects blade 504 to a tension block 530. As discussed above, distal end 510 of blade 504 is connected to a pin 520. Pin 520 may be connected to distal end 510 in any suitable manner, such as by welds, adhesive, a fastener, a rivet, or crimping for example. Pin 520 can have any suitable shape. In the example shown, pin 520 is substantially cylindrical with a circular cross-section. In alternative embodiments, pin 520 is cuboid, pyramidal, or has another regular or irregular shape.

It will be appreciated that blade assembly 500 operates substantially the same as blade assemblies 100 and 200 described above, despite the differences in the structure and mounting of the cutting blades.

Figure 19:
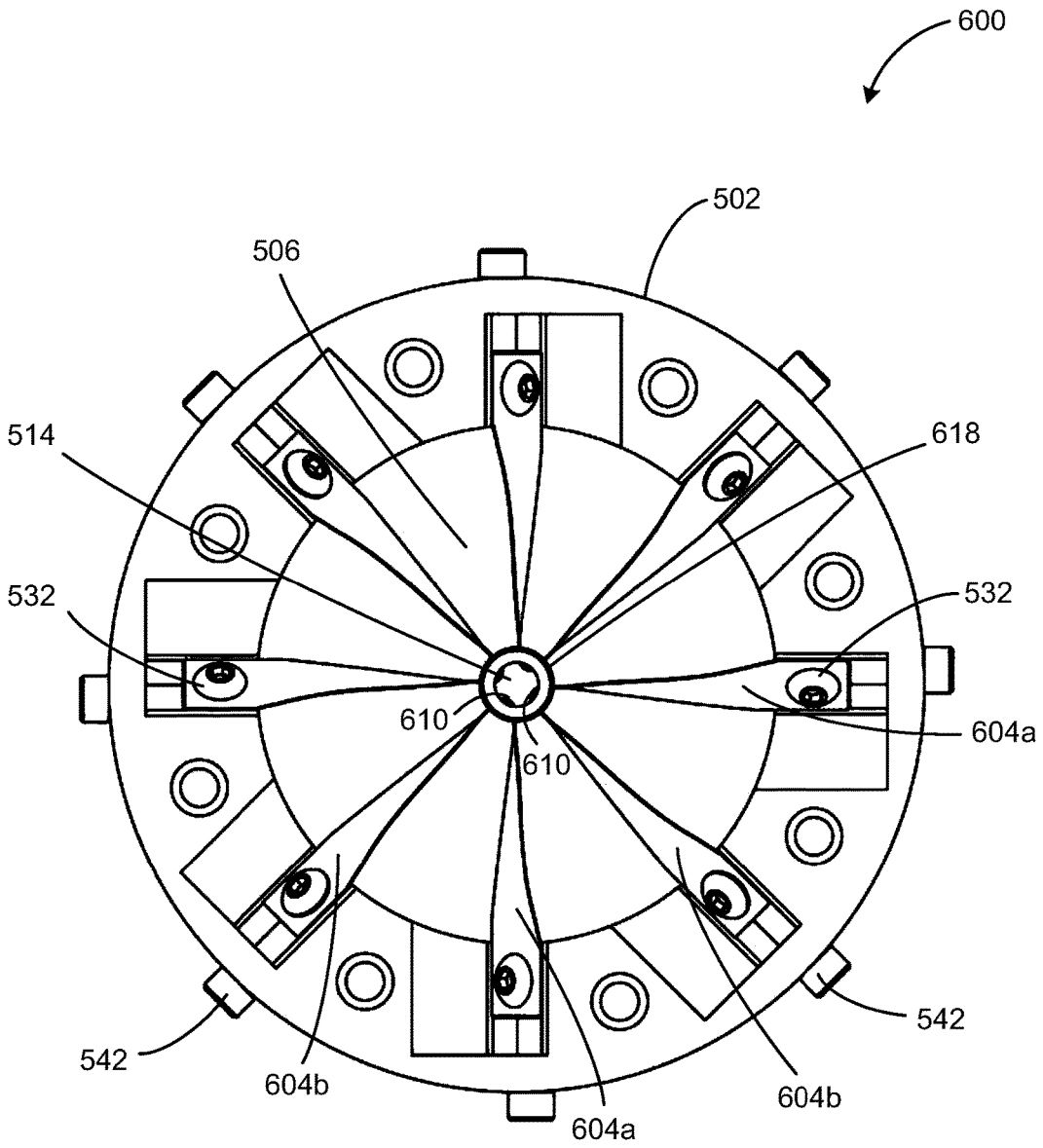
FIG. 19 shows a top plan view of a blade assembly, in accordance with another embodiment.
Figure 20:
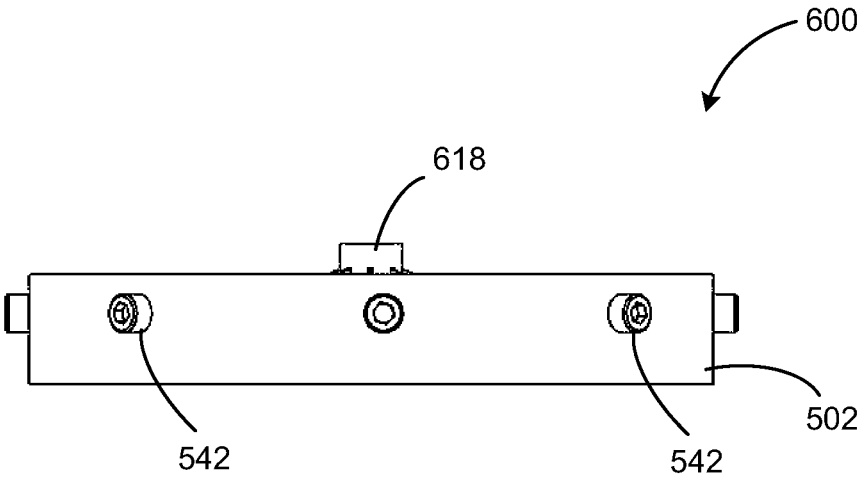
FIG. 20 shows a front elevation view of the blade assembly of FIG. 19.
Figure 21:
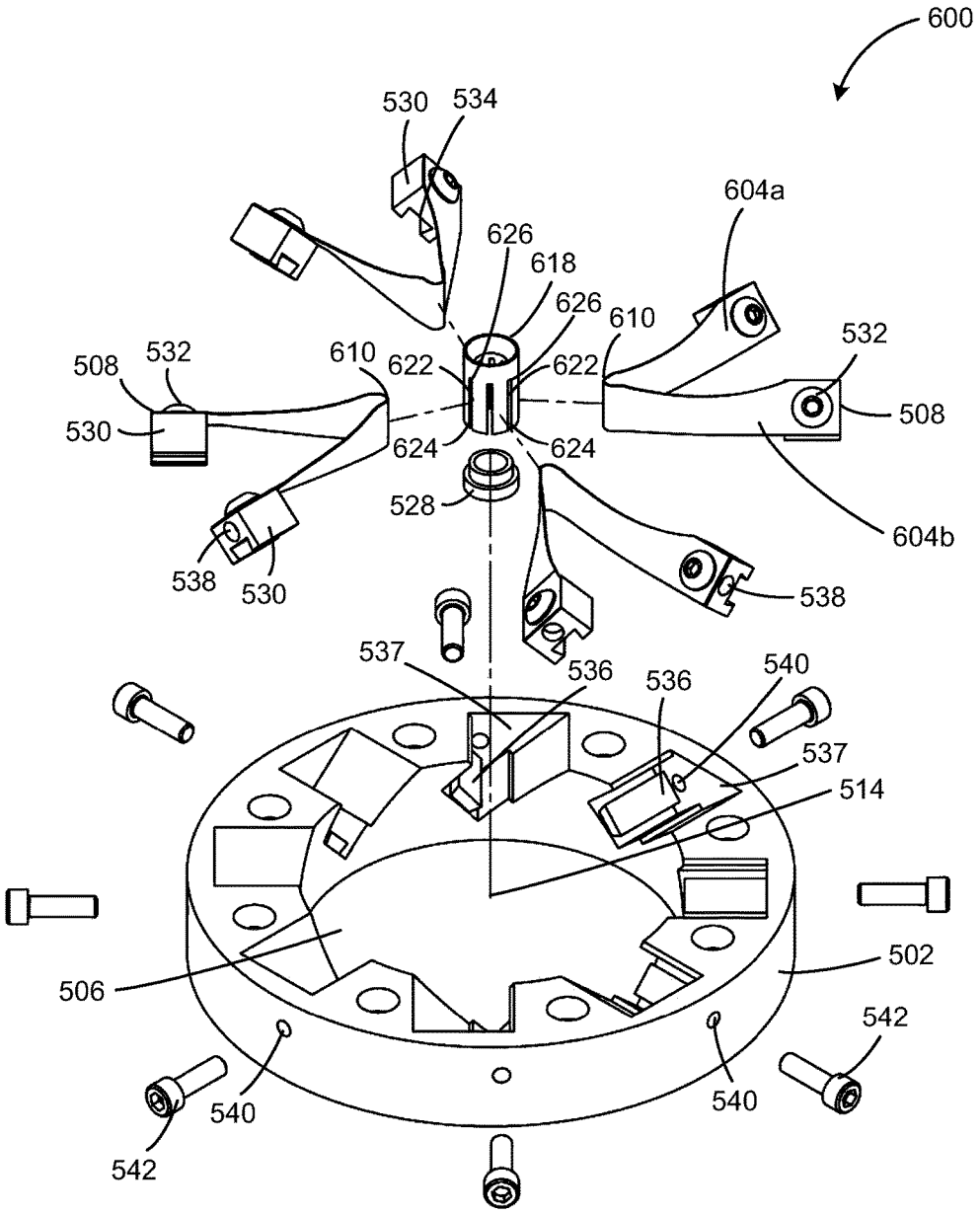
FIG. 21 shows an exploded perspective view of the blade assembly of FIG. 19.

Reference is now made to FIGS. 19-21 where like part numbers refer to like parts in the previous figures, where a blade assembly 600 in accordance with another embodiment is shown. Blade assembly 600 is similar to blade assembly 500 in many respects except, for example, the structure of cutting blades 604 and how they connect with central support 618.

In the example shown, blades 604 of blade assembly 600 include a plurality of pairs of radially adjacent blades 604*a* and 604*b*. Similar to blades 504, blades 604 may be tension blades formed by thin flexible straps of metal. As shown, within each pair of blades, each blade 604 is substantially similar to blades 504 of blade assembly 500. For example, each blade 604 may be twisted along its length and secured to mounting ring 502 in the same manner as blades 504. However, blades 604 differ from blades 504 in that they are arranged in integrally formed pairs of blades 604*a* and 604*b* that are joined by a bent distal portion 610.

As shown, the bent distal portion 610 of each pair of blades 604*a* and 604*b* is positioned inside central support 618 and each of blades 604*a* and 604*b* extend out of central support 618 through a respective slot 622. Each slot 622 is shown including an open lower end 624 where a blade 604 may be inserted, and a closed upper end 626. A cap 528 connects to a lower end of central support 618 to close the lower ends 624 of slots 622 to retain blades 604 in slots 622 and bent distal portions 610 in central support 618.

Figure 22:
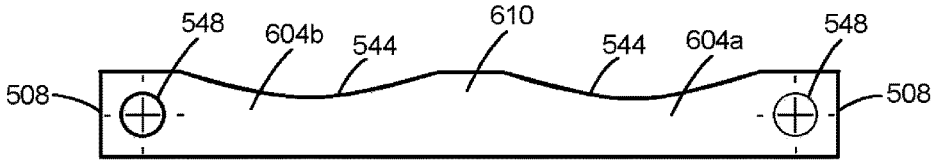
FIG. 22 shows a front elevation view of a cutting blade of the blade assembly of FIG. 19.
Figure 23:
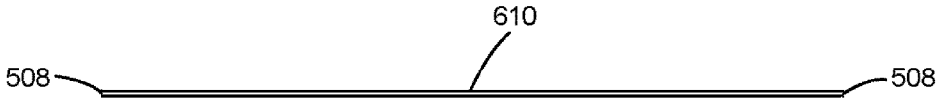
FIG. 23 shows a top plan view of the cutting blade of FIG. 22.

Reference is now made to FIGS. 22 and 23 which show an exemplary pair of cutting blades 604*a* and 604*b*. As shown, pair of cutting blades 604*a* and 604*b* may each be substantially similar to a cutting blade 504, except for example that cutting blades 604*a* and 604*b* are joined by a distal portion 610 rather than terminating with a pin 520.

Figure 24:
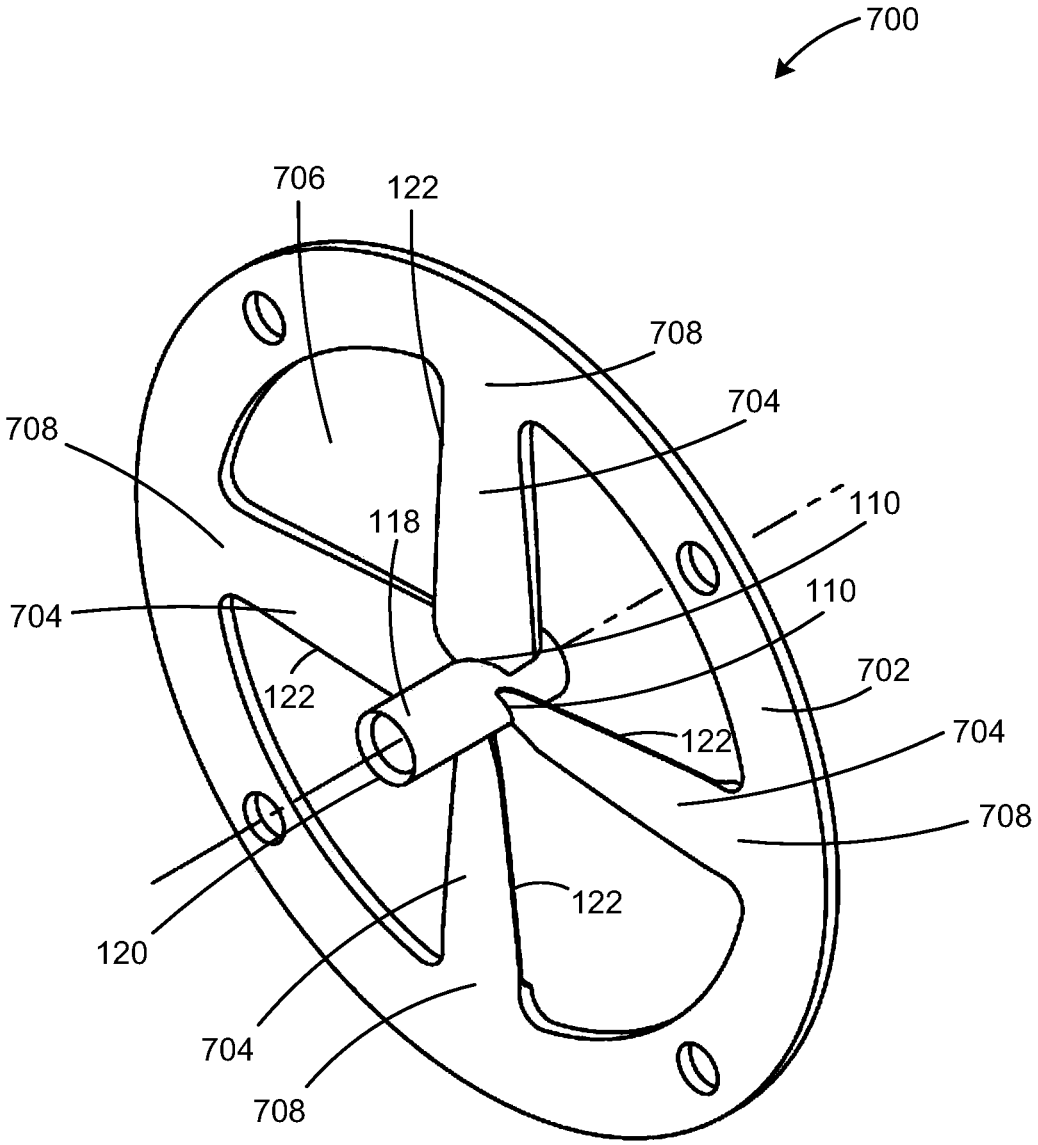
FIG. 24 shows a perspective view of a blade assembly, in accordance with another embodiment.
Figure 25:
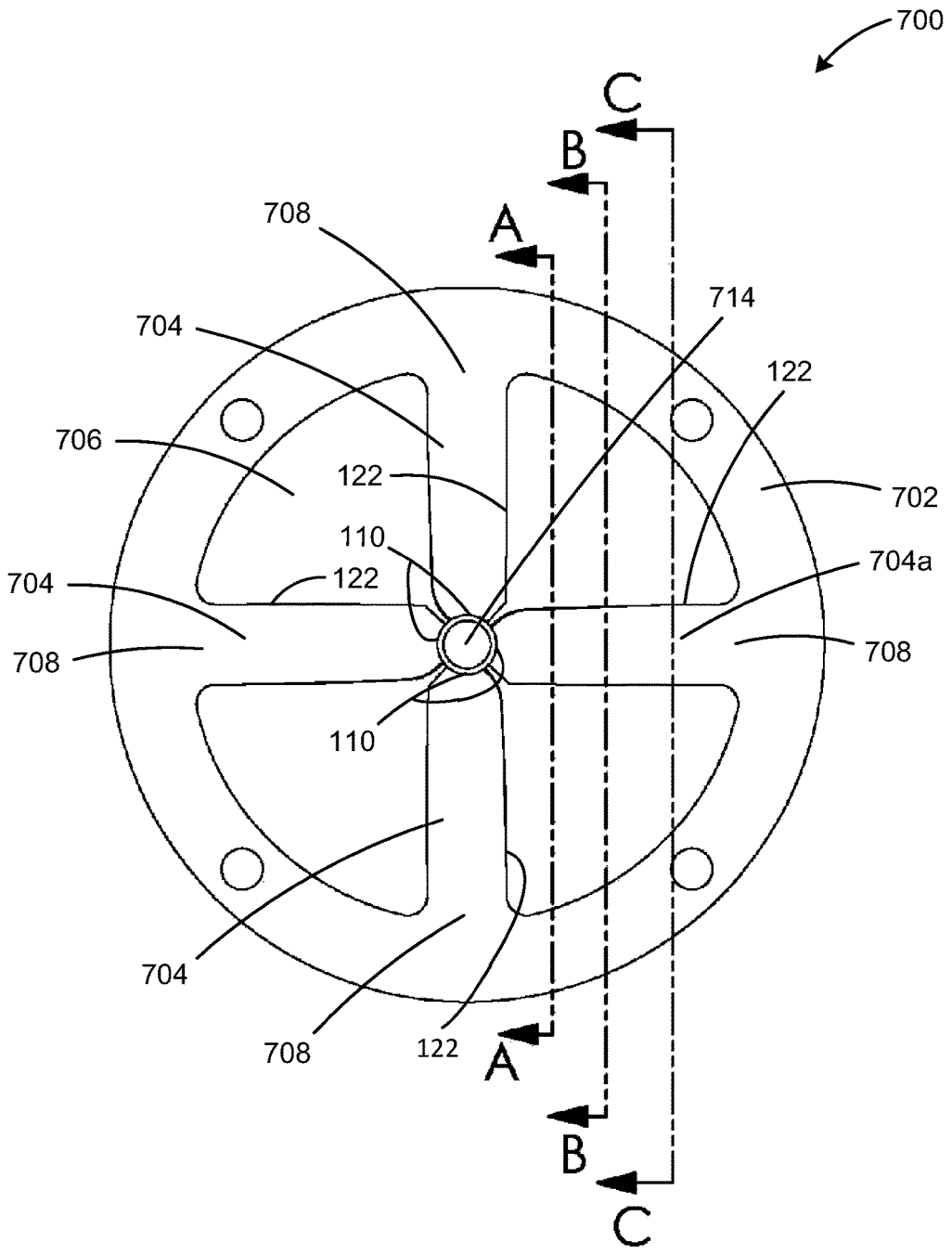
FIG. 25 shows a top plan view of the blade assembly of FIG. 24.
Figure 26:
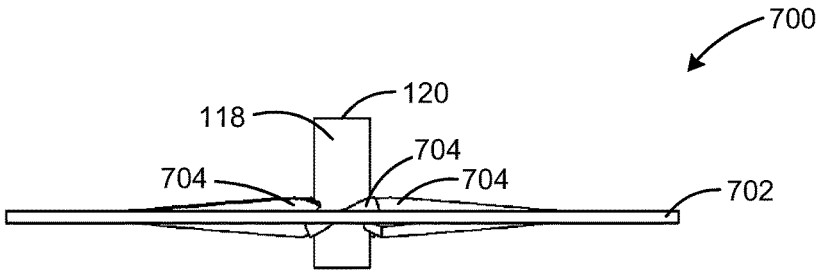
FIG. 26 shows a front elevation view of the blade assembly of FIG. 24.

Reference is now made to FIGS. 24-26, where like part numbers refer to like parts in the previous figures, where a blade assembly 700 in accordance with another embodiment is shown. In the example shown, blade assembly 700 includes a mounting ring 702 defining a circular opening 706 for receiving one or more potatoes in succession, and four cutting blades 704 for slicing the potatoes into discrete segments. The proximal end 708 of each cutting blade is integrally formed with mounting ring 702. This may enhance the structural strength of blade assembly 700 and may permit at least blades 704 and mounting ring 702 of assembly 700 to be easily and inexpensively manufactured by, e.g. stamping from single sheet of metal.

In alternative embodiments, blade assembly 700 may include fewer than four cutting blades 704 (e.g. one to three cutting blades) or greater than four cutting blades 704 (e.g. five to twenty cutting blades). In the example shown, the spacing between radially adjacent blades is equal. In alternative embodiments, the spacing between some radially adjacent blades may be unequal.

Each blade 704 extends from mounting ring 702 across a portion of opening 706 toward a center 714 of mounting ring 702. The distal end 110 of each cutting blade 704 is connected to a central support 118. Distal end 110 of each cutting blade 704 may be connected to central support 118 in any suitable fashion such as by a weld, adhesive, or by integrally forming the cutting blade 702 and central support 118.

In alternative embodiments (not shown), the distal end 110 of each cutting blade 704 may be connected to the distal end 110 of another cutting blade 704 by a connecting member 436.

Preferably, each cutting blade 704 is twisted along its length similarly to blades 104 of blade assembly 100. In the example shown, the angle of attack at the proximal end 708 of each cutting blade 704 is approximately 90 degrees (perpendicular to the flow of potatoes through opening 706). In alternative embodiments (not shown) one or both of mounting ring 702 and cutting blade 704 may be twisted to provide the proximal end 708 of the cutting blade 704 an angle attack of less than 90 degrees (e.g. between 5 and 90 degrees). The angle of attack shown at distal end 110 is approximately 20 degrees. Preferably, the angle of attack at distal end 110 is approximately 60 degrees. However, in alternative embodiments (not shown), the angle of attack at distal end 110 may be less than 60 degrees (e.g. 0 to 59 degrees) or greater than 60 degrees (e.g. 61 to 80 degrees).

Figure 27:
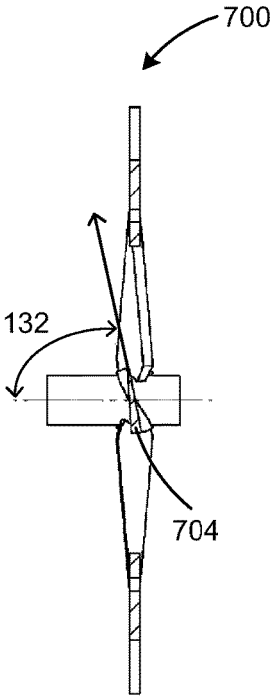
FIG. 27 shows a cross-sectional view taken along line C-C in FIG. 25.
Figure 28:
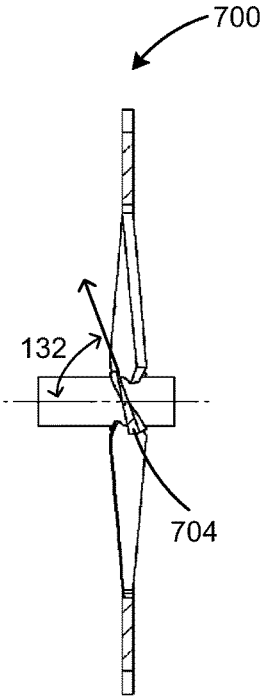
FIG. 28 shows a cross-sectional view taken along line B-B in FIG. 25.
Figure 29:
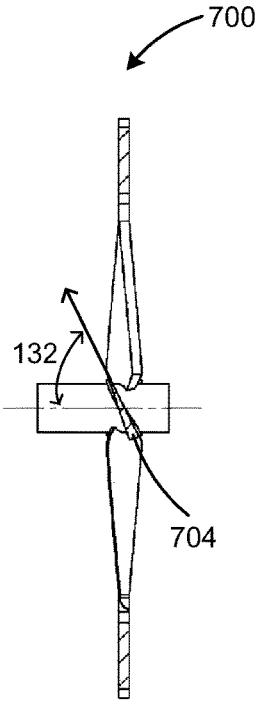
FIG. 29 shows a cross-sectional view taken along line A-A in FIG. 25.

In the example shown, the angle of attack of each cutting blade 704 decreases from proximal end 708 to distal end 110. FIGS. 27-29 show cross-sections of blade assembly 700, intersecting three different radial positions of a blade 704*a*. The cross-section of FIG. 27 intersects blade 704*a* at a position closest to proximal end 708 of the three cross-sections; the cross-section of FIG. 28 intersects blade 704*a* at a position closer to distal end 110 than the cross-section of FIG. 27; and the cross-section of FIG. 29 intersects blade 704*a* at a position closest to distal end 110 of the three cross-sections. As shown, of the three cross-sections, angle of attack 132 is greatest in FIG. 27 (closest to proximal end 708), second greatest in FIG. 28 (intermediate proximal and distal ends 708 and 110), and smallest in FIG. 29 (closest to distal end 110).

Figure 30:
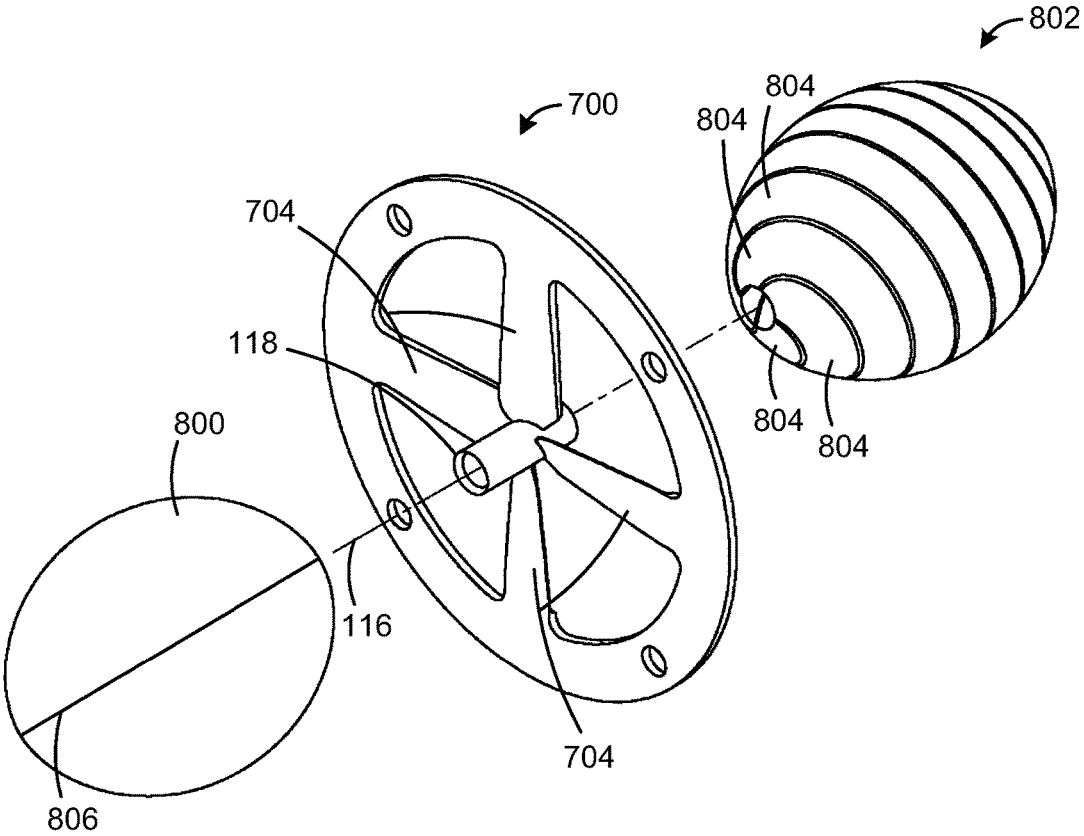
FIG. 30 shows a perspective view of the blade assembly of FIG. 24, a potato before slicing, and a potato after slicing.
Figure 31:
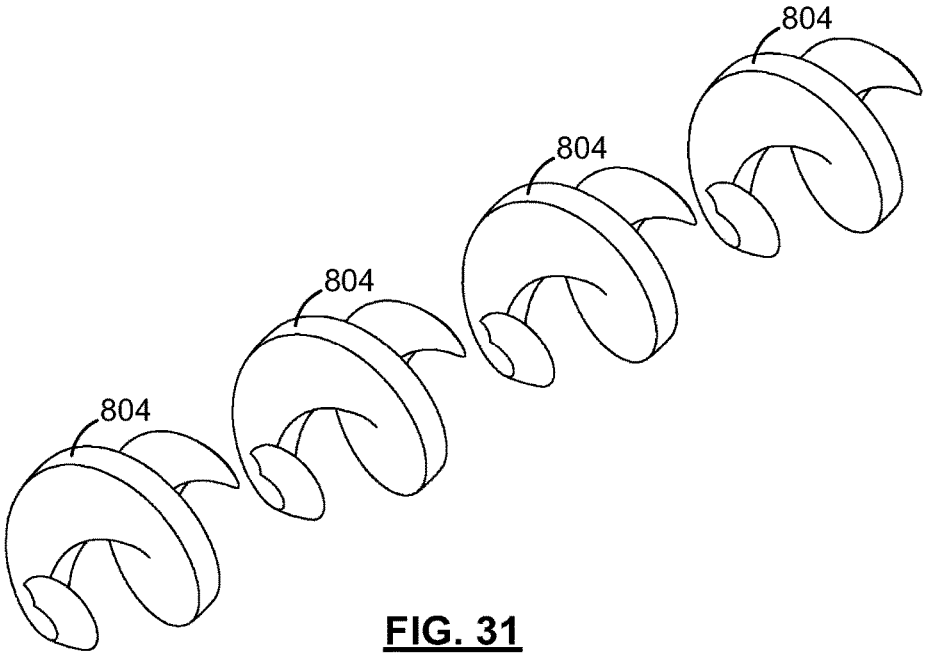
FIG. 31 is a perspective view of the potato pieces of the sliced potato of FIG. 30.
Figure 32:
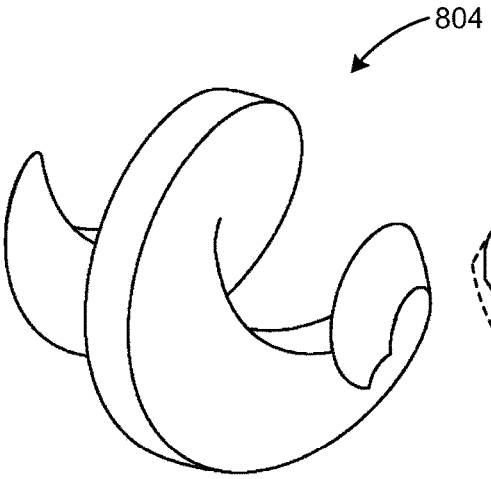
FIG. 32 shows a perspective view of a potato piece of the sliced potato of FIG. 30.
Figure 33:
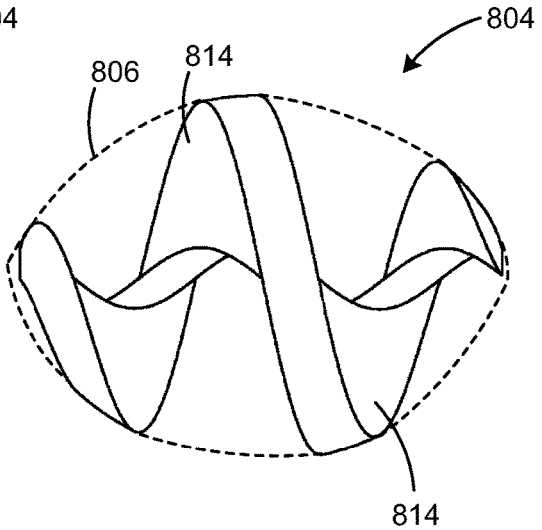
FIG. 33 shows a front elevation view of the potato piece of FIG. 32.
Figure 34:
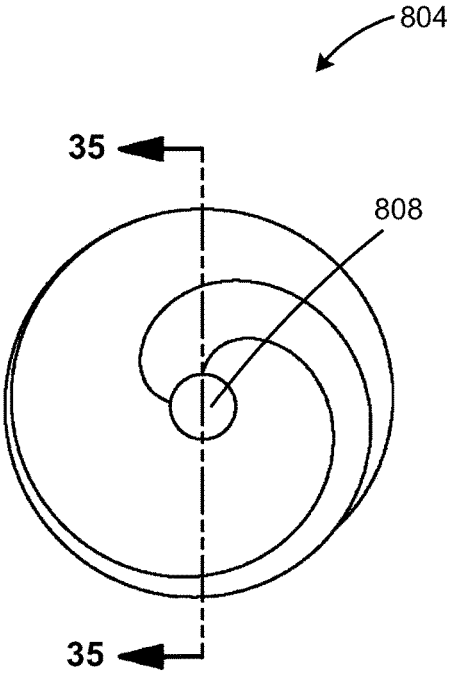
FIG. 34 shows a side elevation view of the potato piece of FIG. 32.
Figure 35:
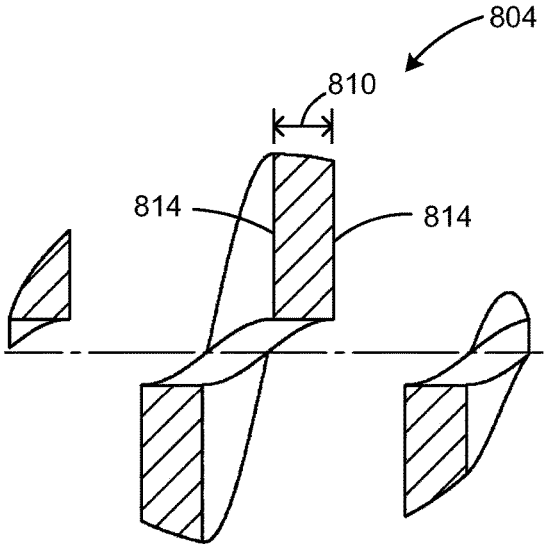
FIG. 35 shows a cross-sectional view taken along line 35-35 in FIG. 34.
Figure 36:
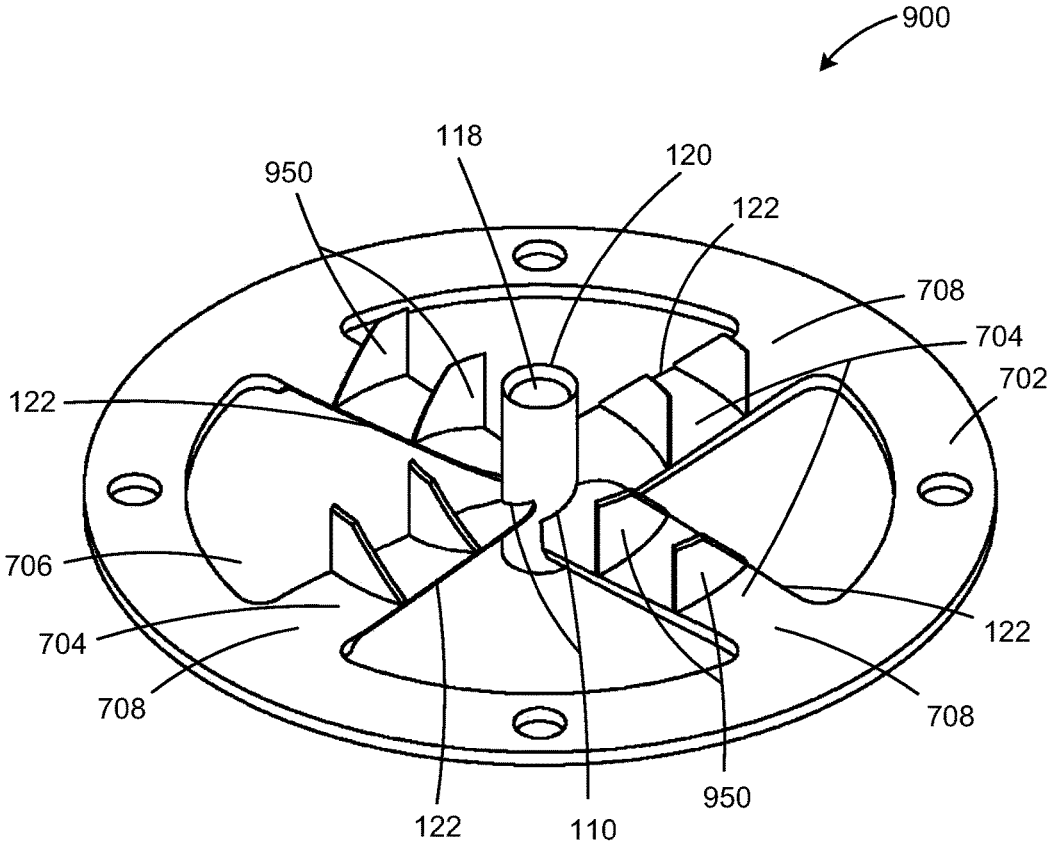
FIG. 36 shows a perspective view of a blade assembly, in accordance with another embodiment.

FIG. 30 shows a perspective view of blade assembly 700, a potato 800 before slicing, and a potato 802 after slicing. FIG. 31 shows the discrete potato pieces 804 of potato 802 cut by blade assembly 700. In the example shown, potato 800 travels toward blades 704 of blade assembly 700 with the longitudinal axis 806 of the potato 800 aligned with the axis of rotation 116 of blade assembly 700. In alternative embodiments, potato 800 may be projected at blades 704 with its longitudinal axis 806 misaligned with axis of rotation 116.

The relative rotation of blade assembly 700 relative to potato 800 (e.g. about axis 116) may be produced by rotating blade assembly 700, rotating potato 800, or a combination of both.

In the example shown, when a potato 800 passes through the rotating blades 704 of blade assembly 700, a sliced potato 802 is produced. As shown, blades 704 of blade assembly 700 slice potato 802 into four potato pieces 804 and central support 118 carves out the core (not shown) of potato 802. As shown, the number of potato pieces 804 generally corresponds with the number of blades 704 in blade assembly 700. For example a blade assembly 700 including six blades 704 may slice a potato 800 into six potato pieces 804.

Reference is now made to FIGS. 30 and 32-35. As shown, potato piece 804 has a helical shape, a side profile 806 that corresponds with the side profile of the potato 800, and a central bore 808 cut by central support 118. Preferably, the thickness 810 of potato piece 804 between side surfaces 814 cut by blades 704 is substantially constant throughout potato piece 804. This may permit potato piece 804 to cook uniformly throughout. The thickness 810 of potato pieces 804 may be a function of the spacing between the two blades 704 that cut side surfaces 814, the relative speeds of rotation (e.g. around axis 116) and movement (e.g. along axis 116) between potato 800 and blade assembly 704. Close spacing between blades 704, slower relative movement and faster relative rotation may each contribute to a thinner potato piece 804, and vice versa.

In some embodiments, one or more of the relative speeds of rotation and movement of potatoes 800 and blade assembly 704 may be varied over time. This may permit the same two radially adjacent blades 704 to cut potato pieces 804 (e.g. from sequential potatoes 800) having different thicknesses 810 by varying the relative speed of rotation and movement between potatoes 800. Further, the thickness 810 of a single potato piece 804 may be varied along its helical length by varying the relative speed of rotation and movement while a potato 800 is being sliced by blade assembly 704. Generally, a variation in thickness 810, whether between different potato pieces 804 or within individual potato pieces 804, may provide an appealing home-style hand cut appearance.

Reference is now made to FIGS. 36-40, where like part numbers refer to like parts in the previous figures, where a blade assembly 900 in accordance with another embodiment is shown. Blade assembly 900 is similar to blade assembly 700 in many respects except, for example, the addition of slitter blades 950.

Figure 37:
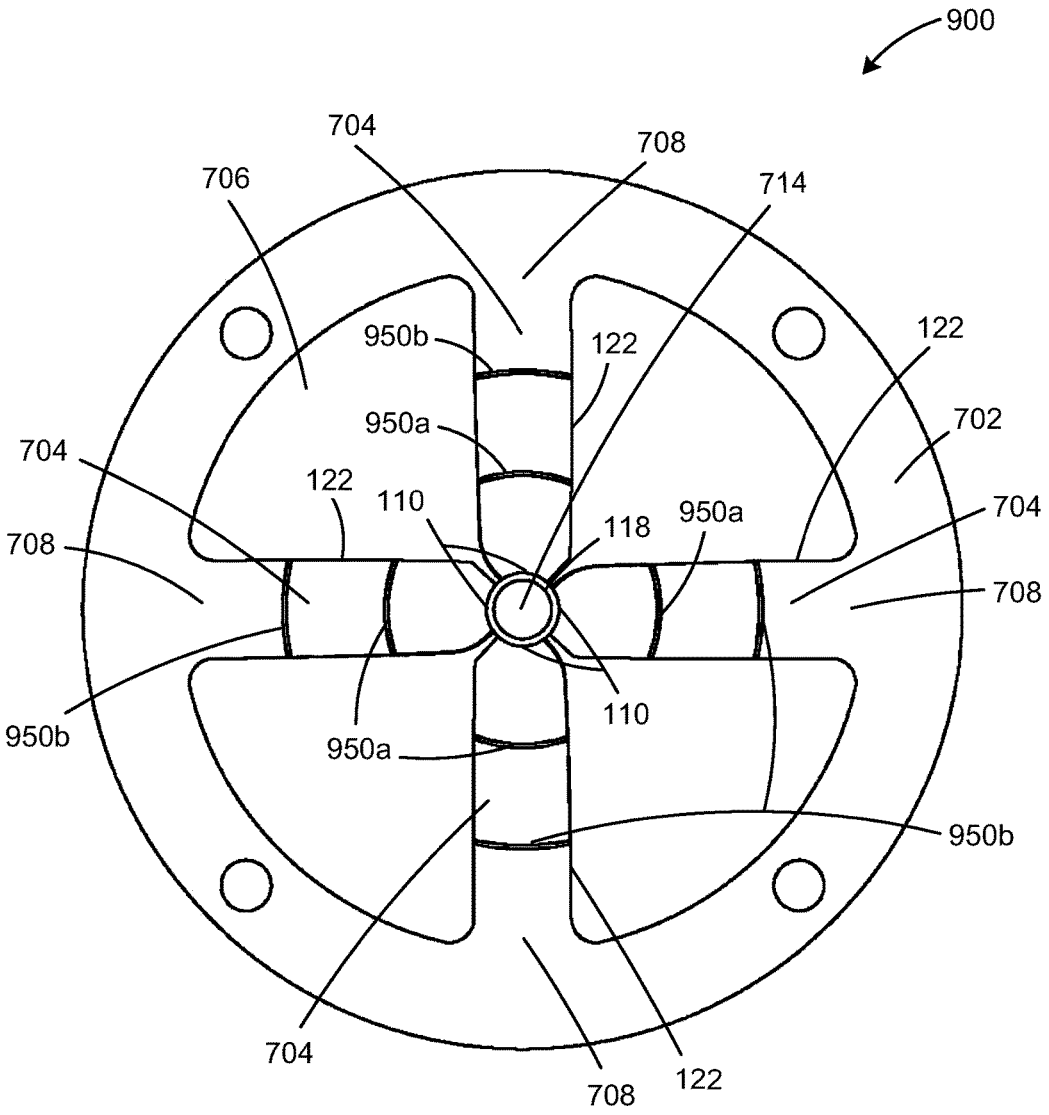
FIG. 37 shows a top plan view of the blade assembly of FIG. 36.
Figure 38:
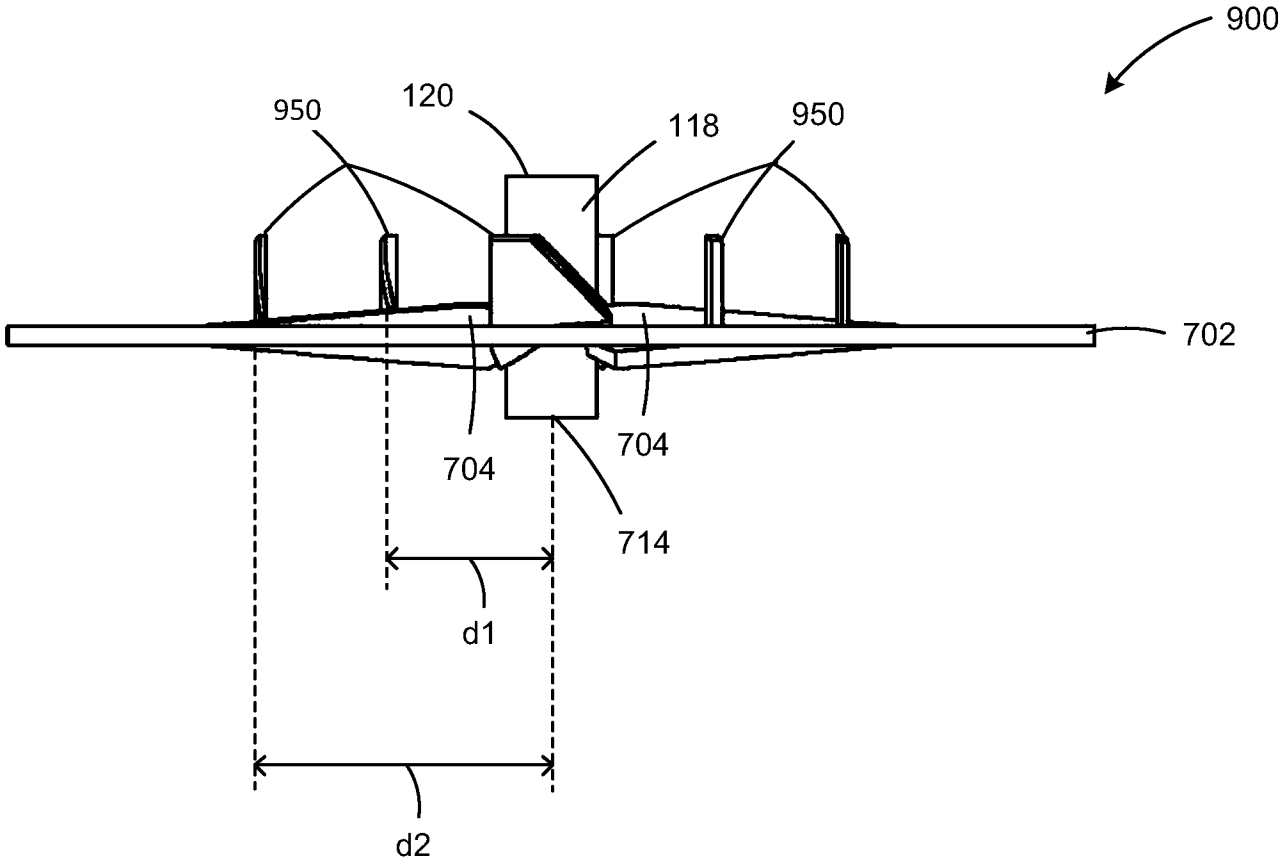
FIG. 38 shows a front elevation view of the blade assembly of FIG. 36.
Figure 39:
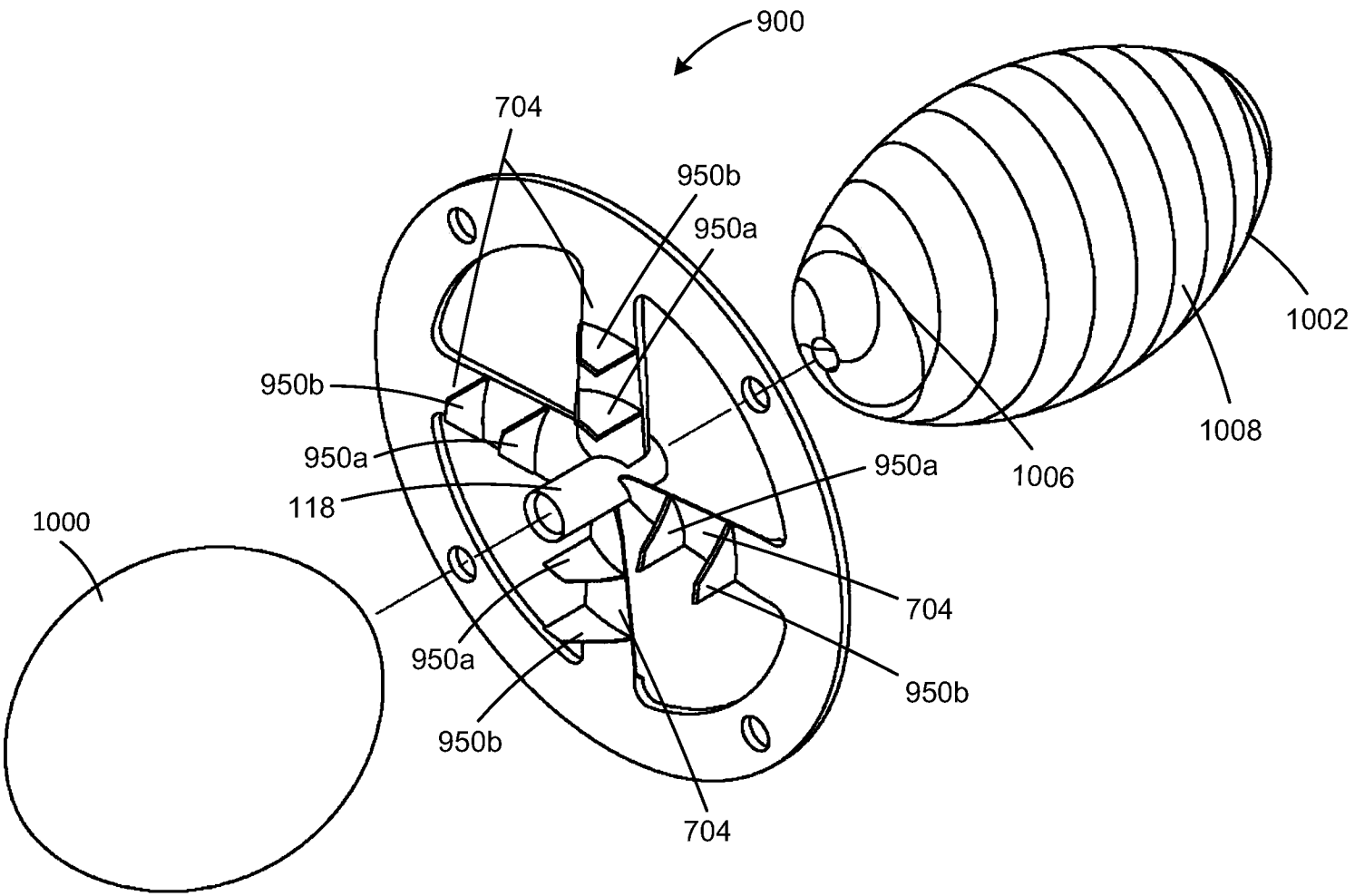
FIG. 39 shows a perspective view of the blade assembly of FIG. 36, a potato before slicing, and a potato after slicing.
Figure 40:
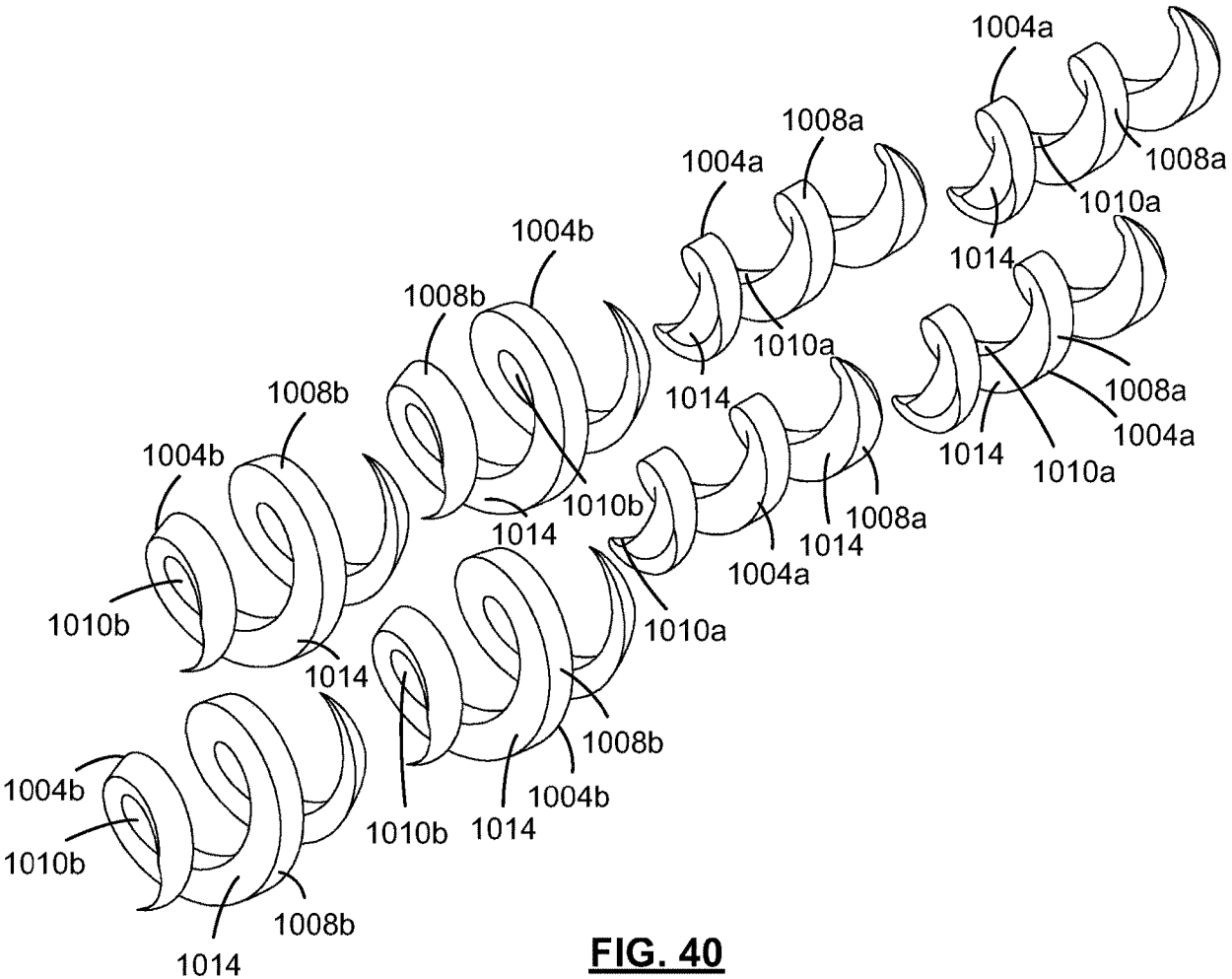
FIG. 40 shows a perspective view of the potato pieces of the sliced potato of FIG. 39.

As shown, each of blades 704 includes a pair of spaced apart slitter blades 950*a* and 950*b* (identified as 950*a* and 950*b* in FIG. 37 only). Preferably, each slitter blade 950 extends substantially in parallel with a direction of flow. In the example shown, slitter blades 950*a* are positioned at a first radial distance d1 from center 714, and slitter blades 950*b* are positioned at a second radial distance d2 from center 714. Distance d2 is greater than distance d1.

Preferably, each slitter blade 950 has an arced profile about center 714, as seen most clearly in FIG. 37. In other embodiments, not shown, one or more slitter blades 950 may instead have a straight profile when viewed in a direction parallel to the upstream direction.

In the example shown, when a potato 1000 passes through the rotating blades 704 of blade assembly 700, a sliced potato 1002 is produced. As shown, blades 704 of blade assembly 900 slice potato 1002 into four potato pieces 1004, and slitter blades 950*a* slice each potato piece 1004 into two potato pieces 1004*a* and 1004*b*.

Each slitter blade 950*a* is responsible dividing a different one of potato pieces 1004 into two potato pieces 1004*a* and 1004*b*. Each potato piece 1004*a* and 1004*b* includes an outer surface 1008*a* or 1008*b*, and an inner surface 1010*a* or 1010*b*. Within each pair of corresponding potato pieces 1004*a* and 1004*b*, the outer surface 1008*a* of inside potato piece 1004*a*, and the inner surface 1010*b* of outside potato piece 1004*b* are cut by one and the same slitter blade 950*a*. In the example shown, the inner surface 1010*a* of each inside potato piece 1004 is cut by central support 118, and the outer surface 1008*b* of each outside potato piece 1004*b* is left uncut by blade assembly 900 because potato 1000 as shown is not big enough to engage slitter blades 950*b*. If potato 1000 was larger, then slitter blades 950*b* might further divide potato pieces 1004 into a third potato piece.

In the example shown, slitter blades 950 are flat blades that cut smooth inner and outer surfaces 1010 and 1008. In alterative embodiments, slitter blades 950 may be structured to impart patterns and textures into inner and outer surfaces 1010 and 1008, such as crinkles, waves, a rough finish or a smooth finish. For example, any one or more of slitter blades 950 may be curved, wavy, crinkled, or corrugated to cut potato pieces 1004 with correspondingly patterned inner and/or outer surfaces 1010 and 1008.

The outside diameter of each inside piece 1004*a* is equal to twice the distance d1 between center 714 and the slitter blade 950*a* that cuts that inside piece 1004*a*. Preferably, the distances d1 between center 714 and slitter blades 950*a* are equal. In this case, slitter blades 950*a* collectively form a circular bore 1006 through sliced potato 1002, and the outside diameters of inside pieces 1004*a* are equal. In alternative embodiments (not shown), the distances d1 between center 714 and slitter blade 950*a* may vary within blade assembly 900. Similarly, the distances d2 between center 714 and slitter blades 950*b* may vary within blade assembly 900. This may cut potato pieces 1004*a* having different outside diameters, and cut potato pieces 1004*b* having different inside and/or outside diameters. In turn, this may provide potato pieces 1004*a* and 1004*b* with an appealing homestyle hand-cut appearance.

Any number of slitter blades 950 may extend from each blade 704 in a direction parallel to the direction of flow. In the example shown, slitter blades 950 extend upstream from the upstream side of each blade 704. In alternative embodiments, one or more slitter blades 950 extend downstream from the downstream side of one or more of blades 704. For example, all slitter blades 950 may extend upstream, all slitter blades 950 may extend downstream, or there may be a mix of slitter blades 950 extending upstream and downstream. In the example shown, two slitter blades 950 extend from each blade 704. In alternative embodiments, zero to ten slitter blades 950 may extend from each blade 704, which may divide a corresponding potato piece 1004 into 1 to 11 pieces, respectively. Further, the same or a different number of slitter blades 950 may extend from each blade 704.

Figure 41:
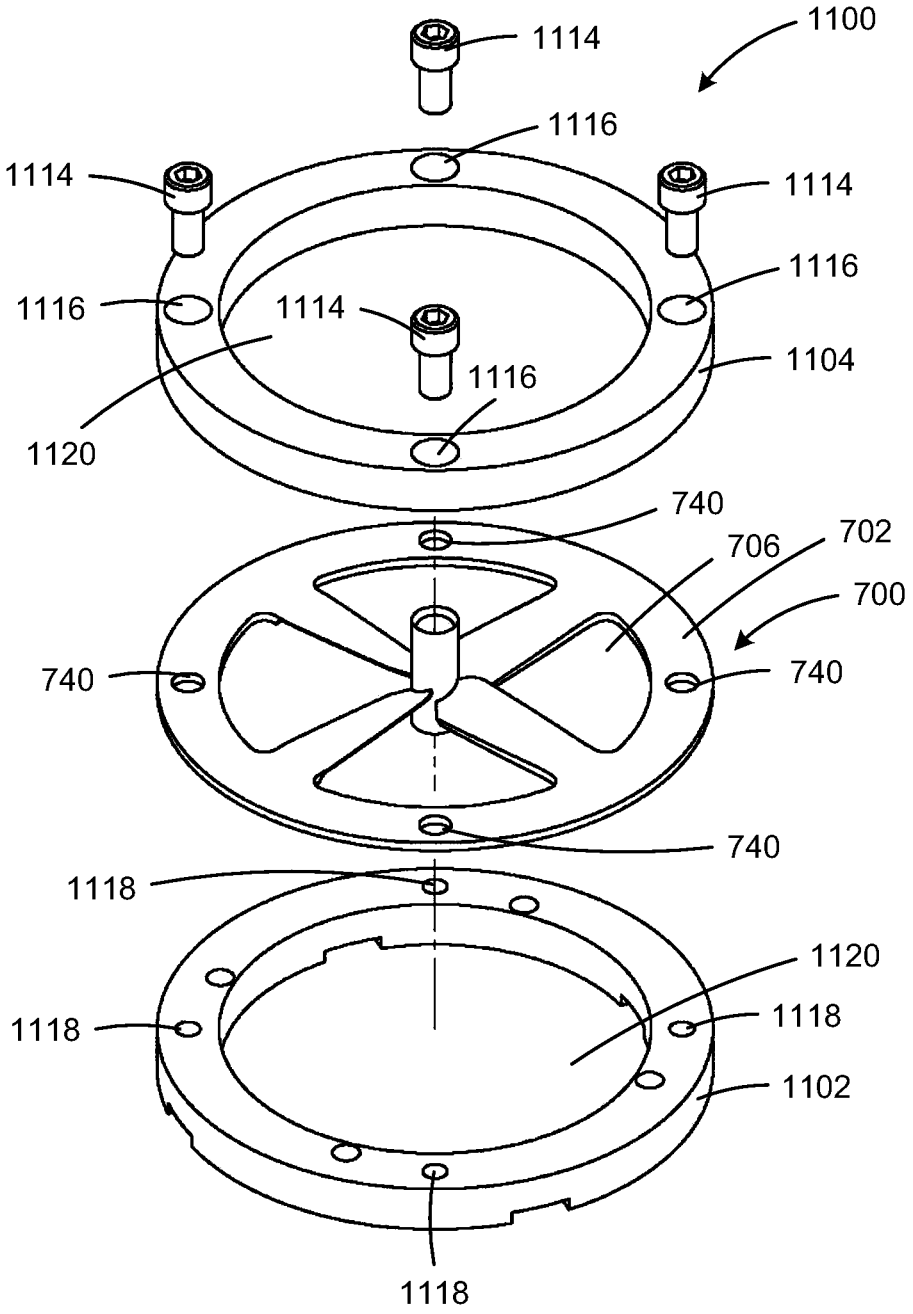
FIG. 41 shows an exploded perspective view of a food cutting device, including the blade assembly of FIG. 24, in accordance with at least one embodiment.
Figure 42:
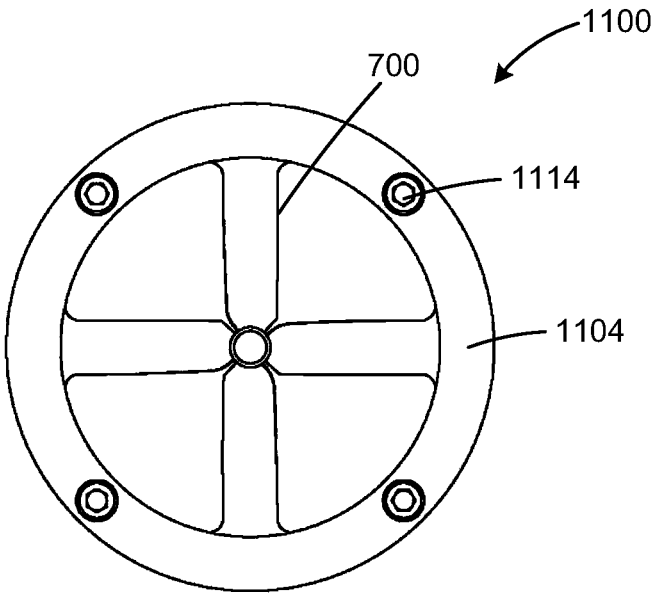
FIG. 42 shows a top plan view of the food cutting device of FIG. 41.
Figure 43:
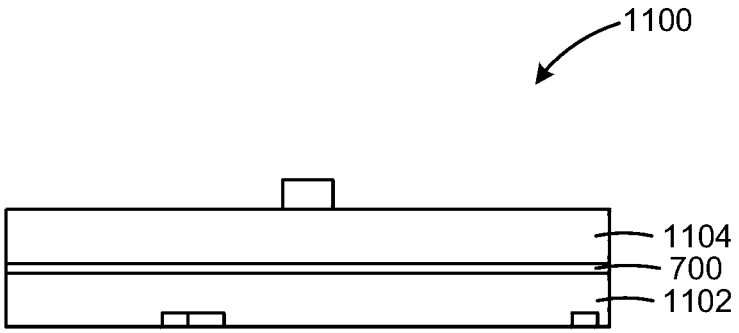
FIG. 43 shows a front elevation view of the food cutting device of FIG. 41.

FIGS. 41-43 show a food cutting device 1100 incorporating a blade assembly 700. In alternative embodiments, blade assembly 700 may be substituted by blade assembly 900. As shown, blade assembly 700 is sandwiched between a housing 1102 and a cover plate 1104. Blade assembly 700 may be secured between housing 1102 and cover plate 1104 in any suitable fashion, such as by screws 1114, welds, rivets, adhesives, or clamps. In the example shown, cover plate 1104 includes mounting apertures 1116 which align with mounting apertures 740 in blade assembly 700 and mounting aperture 1118 in housing 1102. Screws 1114 extend through mounting apertures 1116, 740, and 1118 to securely join cover plate 1104, blade assembly 700 and housing 1102. In some embodiments, blade assembly 700 may be releasably secured to housing 1102 and cover plate 1104 to permit a worn or damaged blade assembly 700 to be replaced or repaired.

As shown, each of housing 1104 and cover plate 1102 defines an opening 1120 which aligns with opening 706 of mounting ring 702 of blade assembly 700 through which potatoes can pass.

Figure 44:
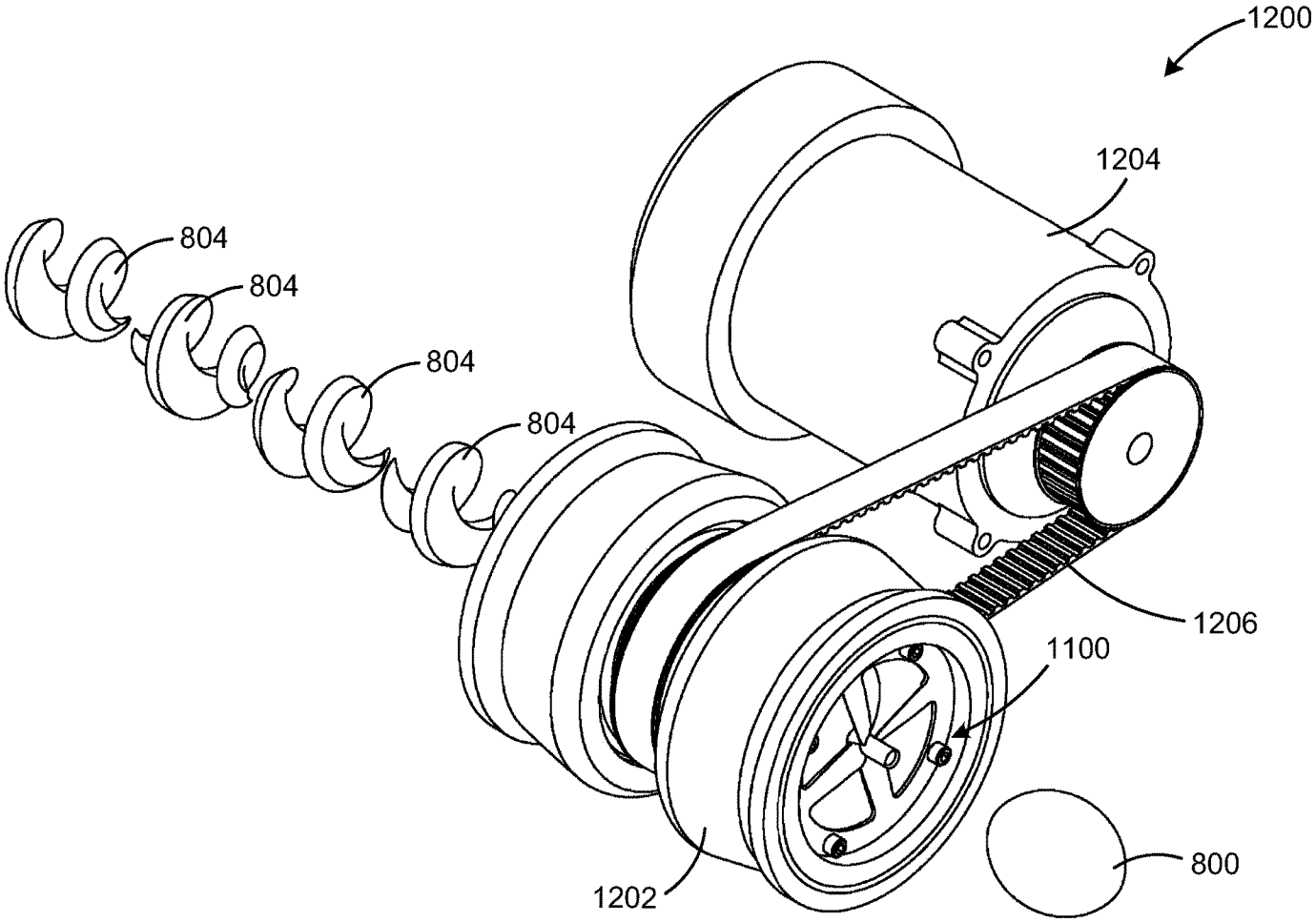
FIG. 44 shows a food cutting system, including the food cutting device of FIG. 41, in accordance with at least one embodiment.

FIG. 44 shows a food cutting system 1200. Food cutting system 1200 includes food cutting device 1100 mounted for rotation inside a conduit 1202. In the example shown, food cutting device 1100 is connected to a motor 1204 by way of a belt 1206. In operation, motor 1204 drives belt 1206 which in turn drives food cutting device 1100 to rotate. A potato 800 (e.g. entrained in a high speed flow of water) may be projected at the rotating food cutting device 1100 which slices the potato 800 into potato pieces 804.

In the examples shown, blades 104, 404, 504, 604, and 704 are straight edged which may cut potato pieces 306, 804, or 1004 with flat side surfaces 314, 814, or 1014. In alternative embodiments, any of blades 104, 404, 504, 604, and 704 may be structured to impart patterns to cut potato pieces 306, 804, or 1004 such as crinkles, waves, a rough finish or a smooth finish. For example, blades 104, 404, 504, 604, and 704 may be curved, wavy, crinkled, or corrugated to cut potato pieces 306, 804, or 1004 with correspondingly patterned side surfaces 314, 814, or 1014. Blades 104, 404,

504, 604, and 704 may have a sharped upstream edge that makes first contact with a potato for cutting the potato into segments. The sharpened edge may be straight cut or hollow grounded for example. In alternative embodiments, blades 104, 404, 504, 604, and 704 are not sharpened.

While the above description provides examples of the embodiments, it will be appreciated that some features and/or functions of the described embodiments are susceptible to modification without departing from the spirit and principles of operation of the described embodiments. For example, two or more of the components described as joined distinct elements in the embodiments may be alternatively integrally formed, such as by computer numeric control (CNC) machining or by powdered metallurgy. Accordingly, what has been described above has been intended to be illustrative of the invention and non-limiting and it will be understood by persons skilled in the art that other variants and modifications may be made without departing from the scope of the invention as defined in the claims appended hereto. The scope of the claims should not be limited by the preferred embodiments and examples, but should be given the broadest interpretation consistent with the description as a whole.

The invention claimed is:

1. A blade assembly comprising:
a mounting ring;
at least two elongate cutting blades, each cutting blade having a proximal end connected to the mounting ring,
each cutting blade extending from the mounting ring toward a center of the mounting ring, each cutting blade being twisted along a length of the cutting blade; and
a substantially circular central support positioned substantially at the center of the mounting ring,
wherein a distal end of each cutting blade is connected to the central support.

2. The blade assembly of claim 1, wherein
each cutting blade is held in tension between the mounting ring and the central support.

3. The blade assembly of claim 2, wherein
for each cutting blade, the mounting ring includes a recess for receiving the proximal end of the cutting blade and the cutting blade is positionable along the recess to adjust a tension in the blade.

4. The blade assembly of claim 2, wherein
the proximal end of each cutting blade is connected to a tension block,
each tension block is connected to the mounting ring by a fastener, and
actuating the fastener causes the tension block to slide within the recess, thereby changing the tension of the corresponding blade.

5. The blade assembly of claim 1, wherein
each cutting blade is integrally formed with a portion of the central support.

6. The blade assembly of claim 1, wherein
for each cutting blade, the mounting ring includes an angled mounting surface to which a proximal portion of that cutting blade is connected.

7. The blade assembly of claim 1, wherein
an inclination of the upstream edge of each cutting blade and a line representing the direction of flow define an angle of attack therebetween, and
for each cutting blade, the angle of attack decreases between the cutting blade's proximal end and the cutting blade's distal end.

8. The blade assembly of claim 7, wherein
for each cutting blade, the angle of attack decreases from a first angle of attack at the proximal end of the cutting blade to a second angle of attack at the distal end of the cutting blade, wherein the second angle of attack is smaller than the first angle of attack, wherein the first angle of attack is in the range of about 15 to 90 degrees, wherein the second angle of attack is in the range of about 0 to 80 degrees.

9. The blade assembly of claim 1, wherein
each cutting blade is equally spaced apart from each radially adjacent cutting blade.

10. The blade assembly of claim 1, wherein the mounting ring is adapted to rotate.

11. A food cutting device comprising:
a housing defining a cavity;
a blade assembly received in the cavity, the blade assembly comprising:
a mounting ring;
at least two elongate cutting blades, each cutting blade having a proximal end connected to the mounting ring,
each cutting blade extending from the mounting ring toward a center of the mounting ring, each cutting blade being twisted along a length of the cutting blade; and
a substantially circular central support positioned substantially at the center of the mounting ring,
wherein a distal end of each cutting blade is connected to the central support; and
a cover plate overlying the blade assembly and removably secured to the housing.

12. The food cutting device of claim 11, further comprising:
a motor drivingly coupled to the blade assembly for rotation of the blade assembly inside the cavity.

13. The food cutting device of claim 12, wherein:
the motor further comprises an output shaft; and
the food cutting device further comprises a belt coupling the output shaft to the blade assembly.

14. The food cutting device of claim 11, further comprising:
bearings coupled to the blade assembly.

15. The food cutting device of claim 11, wherein:
each of the housing and the cover plate include an opening aligned with the center of the mounting ring and sized to permit food to pass through the cutting blades.

16. The food cutting device of claim 11, wherein:
each cutting blade is integrally formed with a portion of the central support.

17. The blade assembly of claim 1, wherein:
the substantially circular central support has a straight cylindrical body.

18. The food cutting device of claim 11, wherein:
the substantially circular central support has a straight cylindrical body.

19. The blade assembly of claim 1, wherein:
the central support has a sharpened upstream end positioned entirely along a plane.

20. The food cutting device of claim 11, wherein:
the central support has a sharpened upstream end positioned entirely along a plane.

21. The blade assembly of claim 1, wherein:
the central support has a sharpened upstream end with an interior bevel.

22. The food cutting device of claim 11, wherein:
the central support has a sharpened upstream end with an interior bevel.

23. The blade assembly of claim 1, wherein:
the proximal end of each cutting blade has an angle of attack of approximately 90 degrees.

24. The food cutting device of claim 11, wherein:
the proximal end of each cutting blade has an angle of attack of approximately 90 degrees.

25. The blade assembly of claim 1, wherein:
the blade assembly is stationary when cutting food products.

26. The food cutting device of claim 11, wherein:
the blade assembly is stationary.

* * * * *